US005812674A

United States Patent [19]

Jot et al.

[11] Patent Number: 5,812,674

[45] Date of Patent: Sep. 22, 1998

[54] METHOD TO SIMULATE THE ACOUSTICAL QUALITY OF A ROOM AND ASSOCIATED AUDIO-DIGITAL PROCESSOR

[75] Inventors: Jean Marc Jot; Jean-Pascal Jullien; Olivier Warusfel, all of Paris, France

[73] Assignee: France Telecom, Paris, France

[21] Appl. No.: 700,073

[22] Filed: Aug. 20, 1996

[30] Foreign Application Priority Data

Aug. 25, 1995 [FR] France ..... 95 10111

[51] Int. Cl.[6] ..... H04R 5/00

[52] U.S. Cl. ..... 381/17; 381/18; 381/63

[58] Field of Search ..... 381/17, 18, 61, 381/63, 1

[56] References Cited

U.S. PATENT DOCUMENTS

| | | | |
|---|---|---|---|
| 4,332,979 | 6/1982 | Fischer . | |
| 4,638,506 | 1/1987 | Han . | |
| 4,817,149 | 3/1989 | Myers | 381/63 |
| 5,105,462 | 4/1992 | Lowe et al. . | |
| 5,142,586 | 8/1992 | Berkhout | 381/63 |
| 5,212,733 | 5/1993 | DeVitt et al. . | |
| 5,384,854 | 1/1995 | Downs et al. . | |
| 5,467,401 | 11/1995 | Nagamitsu et al. | 381/17 |
| 5,555,306 | 9/1996 | Gerzon | 381/63 |
| 5,636,283 | 6/1997 | Hill et al. | 381/17 |

FOREIGN PATENT DOCUMENTS

| | | |
|---|---|---|
| 0 276 948 A2 | 1/1988 | European Pat. Off. . |
| 0 343 691 A2 | 5/1989 | European Pat. Off. . |

OTHER PUBLICATIONS

Moore, "A General Model for Spatial Processing of Sounds", Computer Music Journal, 1983.

*Primary Examiner*—Curtis A. Kuntz
*Assistant Examiner*—Ping W. Lee
*Attorney, Agent, or Firm*—Nilles & Nilles SC

[57] ABSTRACT

A method for the simulation of the acoustical quality produced by a virtual sound source and for the localizing of this source with respect to one or more listeners, and one or more original sound sources. This method consists in: 1) fixing values of perceptual parameters defining the acoustical quality to be simulated and values of parameters defining the localization of a virtual source, 2) converting these values into a pulse response described by its energy distribution as a function of the time and the frequency, 3) carrying out a context compensation so as to take account of an existing room effect, 4) obtaining an artificial reverberation from elementary signals so as to achieve a virtual acoustic environment in real time and control the localizing of the virtual source. This method can be used to modify sound signals coming from a real source, or to create sound effects on recording media. An acoustic virtual processor which enables implementation of this method comprises a signal processing "room" module that enables the obtaining of an artificial reverberation and a signal processing "pan" module enabling the controlling of the localization and the movement of the sound source and that carries out a format conversion into another reproduction mode. The acoustic virtual processor can be used to fit out all types of entertainment halls or games halls.

15 Claims, 13 Drawing Sheets

METHOD TO SIMULATE THE ACOUSTICAL QUALITY OF A ROOM AND ASSOCIATED AUDIO-DIGITAL PROCESSOR

BACKGROUND OF THE INVENTION

1. Field of the Invention

The invention relates to a method for the simulation of the acoustical quality of a room. This method can be used to control or reproduce the localization of a sound source and the conversion of the sounds emitted by this source that results from their projection in a real or virtual room.

With this method, there is associated an audio-digital processor that can be used, through one or more input signals, to achieve the real-time control and synthesis of a room effect, the localizing of the sound source and the reproduction of signals on headphones or on various loudspeaker devices. A plurality of processors may be associated in parallel in order to simultaneously reproduce a plurality of different sound sources on the same headphone or loudspeaker device.

Through this method and the associated processor, it is possible to modify the sound signals coming from a real acoustic source, a recording or a synthesizer. Furthermore, the method and the associated processor may be applied in particular to sound installations for concerts or shows, the production of recordings for the cinematographic or music industry and finally to the setting up of interactive simulation systems such as flight simulators or video games. The method that is an object of the present invention can be used especially to modify the acoustics of a listening room by faithfully recreating the acoustics of another room, so as to give the listeners the impression that a concert for example is taking place in this other room.

2. Description of the Prior Art

Fairly recent publications reveal a certain degree of interest in a descriptive approach to acoustical quality in terms of perceptual factors. This is described in the publication "Some New Considerations on the Subjective Impression of Reverberance and its Correlation With Objective Criteria", ASA Conference, Cambridge, May 1994 and in the publication "Some Results on the Objective Characterization of Room Acoustical Quality in both Laboratory and Real Environments", Proc. I.O.A., Vol. 14, Part 2, pp. 77–84, 1992.

The publication entitled "The Simulation of Moving Sound Sources" in the Journal of Audio Engineering Society, pages 2 to 6, 1971, describes a program enabling the control of the localization and movement of a sound source in a virtual acoustic space. In the case of the simultaneous reproduction of several virtual sources, numbered 1 to N, using a device with four loudspeakers surrounding the listeners, this program is implemented by the processor shown in FIG. 1*a*. The direction from which each source signal comes is synthesized by means of a panoramic potentiometer referenced "Pan", enabling the distribution of the source signal to one or more of the four loudspeakers, by means of a multichannel output bus 1 and amplifiers 2. Furthermore, all the signals coming from the sources 1 to N supply an artificial reverberator referenced "Rev" that gives a different sound signal to each of the loudspeakers. Gains $d_1$ to $d_N$ enable the control of the amplitude of the direct sound of each sound source. Gains $r_1$ to $r_N$ enable the control of the amplitude of the reverberated sound of each sound source.

However, this program has drawbacks. Indeed, since it cannot be used to modify the amplitudes and directions of the primary reflections independently of the late reverberation, it cannot be used for the faithful reproduction of the distance or rotation of a sound source in a natural acoustic environment. Furthermore, since the primary reflections are broadcast by all the loudspeakers, it is necessary for the listener or listeners to be located close to the center of the device so that the direction of origin defined by the direct sound is faithfully reproduced. If the listener is too close to a loudspeaker, the primary reflection signals coming from this loudspeaker may reach him before the direct sound and therefore replace this direct sound perceptibly. Furthermore, a processor such as the one shown in FIG. 1*a* forms a heterogeneous system in which the localization of the sound sources and the effect of reverberation are reproduced by means of distinct pieces of equipment so as to achieve simultaneously management of the directional and temporal aspects of the sound sources. Now, the use of distinct pieces of equipment is complex and costly and implies the use of a control interface that is inconvenient for the user.

An article entitled "A General Model for the Spatial Processing of Sounds" in Computer Music Journal, Vol. 7, No. 6, 1983, describes an extension of the above program. This extension makes it possible, for each virtual sound source and for each loudspeaker of the reproduction device, to control the dates and amplitudes of the artificial primary reflections. For this purpose, it takes account of the geometry of the loudspeaker device, the geometry of the virtual room, the acoustical absorption characteristics of air and of the walls of the virtual room, and finally the position, directivity and orientation of each virtual sound source.

The drawback of this method lies in the fact that it cannot be used for the direct and efficient control of the sensation perceived by the listener during the reproduction of the acoustics. Indeed, this sensation may be divided into effects of two types: the localizing of the virtual sound source in terms of direction and distance and the acoustical quality defined as the combination of the temporal, frequency and directional effects prompted by the virtual room on the sound signals radiated by the virtual sound source.

Now, while the sensation of localization can be controlled by this method, acoustical quality on the contrary can be controlled only by means of the geometrical and physical description of the virtual room and the sound sources. This approach has a certain number of drawbacks in a context where the application is musical or artistic. For, the control needed for the updating of the dates and amplitudes of the primary reflections, for each sound source and each loudspeaker, is complex and costly in terms of computation resources. Furthermore, the control parameters of a processor used to implement this method are not relevant on the perceptual plane. In order that a setting method may be relevant, it is necessary to tend towards a one-to-one relationship between the parameters and the perceived effect. The parameters of a processor for the implementation of the method that has just been described do not meet this condition for several setting configurations may prompt the same perceived effect. The perceptual effect of the variation of a physical or geometrical parameter cannot be forecast with precision and is sometimes even non-existent. Finally, this method for the control of the acoustical quality can be used to reproduce only those situations that are capable of being physically achieved. Even if the room of which the model is made is an imaginary room, the laws of physics dictate heavy constraints on the acoustical qualities that can be obtained. For example, in a room with a given volume, a modification of the absorption coefficients of the walls designed to increase the reverberation time in the room will by this very fact create an increase in the intensity of the room effect.

During a use of a method of the kind just described in a concert, the acoustical quality that is actually perceived by a listener results from the cascade association of two filtering operations. These two filtering operations respectively provide for sound conversions achieved by a module 3 for the processing of the sound signals fed into the loudspeakers and sound conversions produced by an acoustic system 4 combining amplifiers, loudspeakers and the listening room, as shown in FIG. 1*b* for a device with four loudspeakers. The second filtering depends on the frequency response of the loudspeakers and their coupling with the listening room which itself depends on the directivity, position and orientation of each of the loudspeakers.

Furthermore, the techniques proposed to date to compensate for the conversion of the signals reproduced by the loudspeakers are designed to eliminate these conversions by the insertion, into the associated virtual acoustic processor, of a corrective filter 5, also called a reverse or equalizer filter, placed upline with respect to the loudspeakers of the acoustic system 4, as shown in FIG. 1*c*. The use of these techniques in a typical listening room, namely in a relatively reverberating room, is very costly in terms of computation resources. Furthermore, through these equalizing techniques, the effect of the listening room can be effectively compensated for only at one reception point or at a limited number of reception points. This compensation therefore does not work in an extensive reception zone such as the auditorium in a concert hall.

Other recent publications have described a perceptual approach to characterizing the acoustical quality of the room. However, none of these publications describes the performance of a method used to control the acoustical quality of a room by means of a sound signal processing module and a device for reproduction on loudspeakers.

The French patent No. FR 92 02528 describes a method and system of artificial spatialization of audio-digital signals to simulate a room effect. This patent describes the use, for this purpose, of structures of reverberating filters enabling the reproduction of late reverberation and of early echoes. However, in such a system, the means for setting the acoustical quality are not coherent since they pertain to different approaches. Thus, control means relating to the geometry of the listening room, the perception of the sound or the processing of the signal are used at the same level. In this case, the reverberating filters therefore do not have any perceptual relevance to the settings since these settings remain independent of one another, several of them possibly producing one and the same room effect. The coexistence of parameters of different natures therefore does not meet the requirements of perceptual relevance mentioned here above. The acoustical quality therefore cannot be controlled directly and efficiently.

The present invention can be used to overcome all the drawbacks that have just been described.

SUMMARY OF THE INVENTION

A first object of the invention pertains to a method for the simulation of the acoustical quality produced by a virtual sound source and for the localizing of this source with respect to one or more listeners, by means of at least one input signal coming from one or more original sound sources, wherein this method comprises the following steps:

1—the fixing, by means of a setting interface, of the values of perceptual factors defining the acoustical quality to be simulated and of the values of parameters defining the localization of a virtual source, 2—the conversion of these values into a pulse response described by its energy distribution as a function of time and frequency, 3—the carrying out of context compensation so as to take account of an existing room effect, 4—the obtaining of an artificial reverberation from the elementary signals coming from the input signal, so as to achieve the real-time creation of a virtual acoustic environment defined in the first step, and 5—the controlling of the localizing of the virtual source.

This method can be used to modify the acoustical quality of an existing room by the simulation, within this room, of the acoustical quality of a virtual room and by the simultaneous reproduction of the temporal aspects and the directional aspects of this acoustical quality. Through this method, the setting means may relate solely to the perception of the reproduced effect by the listener, without there being any recourse to technological parameters that relate to sound signal processing, the geometry of the virtual room or the physical properties of its walls.

Another object of the invention concerns a virtual acoustics processor enabling the implementation of the method according to the invention. This processor comprises a "room" module enabling the obtaining of an artificial reverberation, and a "pan" module enabling the control of the localization and the movement of the sound source and the obtaining of a format conversion into another reproduction mode.

In one mixing application where several virtual sound sources are processed simultaneously and reproduced through one and the same loudspeaker device, several virtual acoustics processors may be associated in parallel as shown in FIG. 1*d*.

In the simplest configuration of the processor, namely when the processor comprises only the "room" module, the output signals may be directly reproduced on a loudspeaker device compatible with the standard 3/2 stereo format or 3/4 stereo format as shown respectively in FIGS. 1*e* and 1*f*, combining three front channels and two or four "surround" channels surrounding a listening position referenced E. In a fuller configuration, the processor may be provided with a second "pan" module capable of obtaining the linear combinations of its input signals so as to enable the control of the localizing of the virtual source and the simultaneous obtaining of a conversion from the previous standard format into another mode of reproduction. The modes of reproduction possible are, for example, the mode of binaural reproduction on headphones, the stereophonic mode, the transaural mode on two loudspeakers or again a multichannel mode.

When the reproduction mode is a binaural mode, the processor reconstructs the acoustic information that has been picked up by two microphones, introduced into the auditory canals of a listener placed in a virtual acoustic field, so as to enable a check on the localization of the source that is three-dimensional inspite of the fact that the transmission is done on two channels only.

The transaural mode enables the reproduction of the same 3D effect on two loudspeakers while the stereophonic mode for its part simulates a sound pickup operation by a pair of microphones. Finally, when the reproduction of the acoustics is done in a multichannel mode, the processor feeds several loudspeakers surrounding the listening zone in the horizontal plane. This mode enables the restitution of a sound scene that depends little on the position of the listener and the reproduction of a scattered room effect coming from every direction.

Thus, the processor that is an object of the invention may be configured so as to achieve the control and reproduction, on various loudspeaker devices or in various recording formats, of the acoustical quality produced by a virtual sound source and, simultaneously, the control and reproduction of the apparent direction of the position of this sound source with respect to the listener. This system shown in FIG. 1*d* therefore forms a mixing console enabling not only the control of the direction of the position of each of the N virtual sources but also, unlike a conventional mixing console as shown in FIG. 1*a*, the direct control of the acoustical quality associated with each of them.

As shall be explained further below in this description, the acoustical quality produced by a sound source includes particularly the sensation of the nearness or remoteness of this source.

In a system such as the one shown in FIG. 1*a*, a conventional mixing console enables the control of the directional effects while an external reverberator achieves the synthesis of the temporal effects. The sensation of the remoteness of the virtual sound sources cannot be controlled with precision by means of only the values of the gains $d_i$ and $r_i$ accessible in the mixing console, for this sensation of remoteness depends also on the settings of the external artificial reverberator. Consequently, the heterogeneous quality of the system very greatly limits the possibilities of continuous variation of the apparent distance of the virtual sound sources.

On the contrary, a mixing console, each channel of which is provided with a processor according to the invention, offers its user a powerful tool for the building of virtual sound fields, for each processor simultaneously integrates the directional effects and the temporal and frequency effects that determine the perception of the localization and the acoustical quality associated with each sound source.

BRIEF DESCRIPTION OF THE DRAWINGS

Other features and advantages of the invention shall appear from the following description, given by way of a non-restrictive exemplary illustration, with reference to the appended figures, of which.

MORE DETAILED DESCRIPTION

Figure 2:
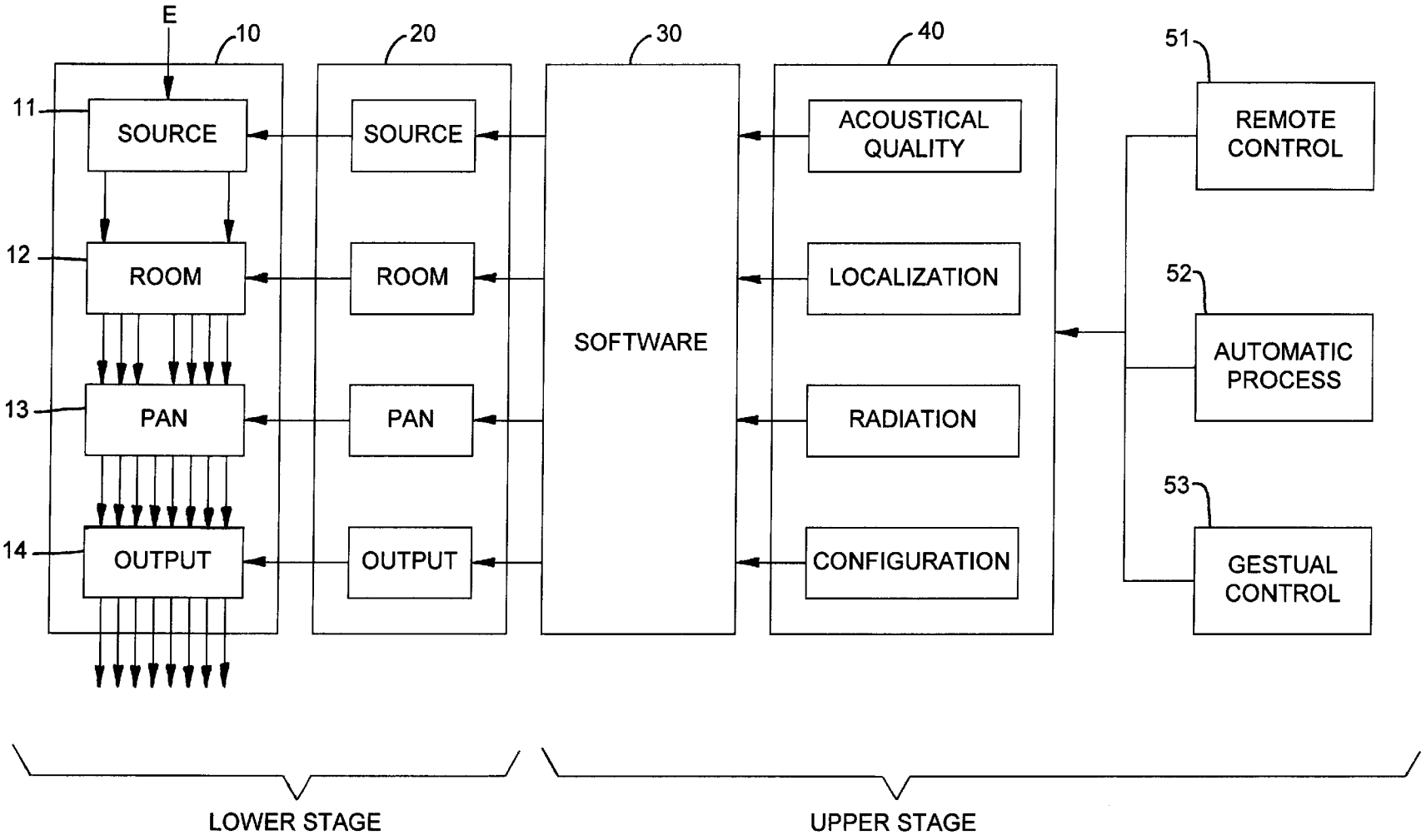
FIG. 2 shows a diagram of a general structure of a processor according to the invention.

To be able to understand the different steps of a method according to the invention, it is preferable initially to describe the general structure of a processor enabling the implementation of this method. A drawing of this general structure is shown in FIG. 2.

According to one embodiment, a processor according to the present invention comprises two stages, a top stage and a bottom stage. The top stage or upper stage is reserved for one or more interfaces 30, 40 enabling the setting of the values of the perceptual factors and the conversion of these values into a pulse response described by its energy distribution as a function of time and frequency. The lower stage on the other hand is reserved for the processing of the sound signals from the data elements given by the interface or interfaces of the upper stage.

The lower stage therefore comprises a module 10 for the digital processing of sound signals. This module 10 itself comprises one or more successive sound processing modules. In the example of FIG. 1 and in the following figures, these modules are four in number: a "source" module 11, a "room" module 12, a "pan" module 13 and a "output" module 14. Each of these modules plays a well-defined role and works independently of the others to enable the reproduction of an acoustical quality and the control of the directional localization of the source on several output channels, through a single input E.

The "source" module 11 is optional. In particular, it provides fixed spectral corrections to an input sound signal E emitted by any source. These spectral corrections enable the differentiation of the direct sound designated as "face", emitted by the source towards a listener and the average scattered sound, designated as "omni", radiated by the source in all directions.

The "room" module 12 for its part is the most important one since it is this module that processes the two types of signals coming from the "source" module and performs an artificial reverberation in order to create a virtual room effect.

The "pan" module 13 make it possible to control sound source localization in direction and at the same to obtain a format conversion into another mode of reproduction.

Finally, the "output" module 14 is optional and enables a fixed spectral and temporal correction to be made to each of the output channels.

In the example shown in FIG. 2, the "pan" module is a matrix with seven inputs that correspond to the output signals of the "room" module, and eight outputs. This means that the reproduction mode is configured on eight channels feeding eight loudspeakers. In another case, such as for example a reproduction on four channels, the number of outputs of the "pan" module is equal to four.

The upper stage of the processor according to the invention preferably has a software interface 30 and a setting interface 40. The setting interface 40 makes it possible to define the acoustics to be simulated in terms of perceptual factors. Advantageously, the software interface 30 comprises a working program associated with the setting interface 40. This program enables the conversion of the values of the perceptual factors, fixed by means of the setting interface 40, into a pulse response described by its energy distribution as a function of time and frequency. The perceptual factors act independently on one or more energy values.

In addition, an alternative implementation, illustrated in FIG. 2, consists in placing a second setting interface 20 at the lower stage to enable a direct setting of the parameters expressed in terms of energy, a checking operation and a display of one or more of the processing modules. The settings of the acoustical quality by means of this second setting interface 20 are not done in terms of perceptual factors but in terms of energy values. Furthermore, this interface 20 is wholly transparent to the control messages coming from the setting interface 40 of the upper stage. It makes it possible only to obtain a direct control or display of the values of the parameters of the lower stage.

Figure 3:
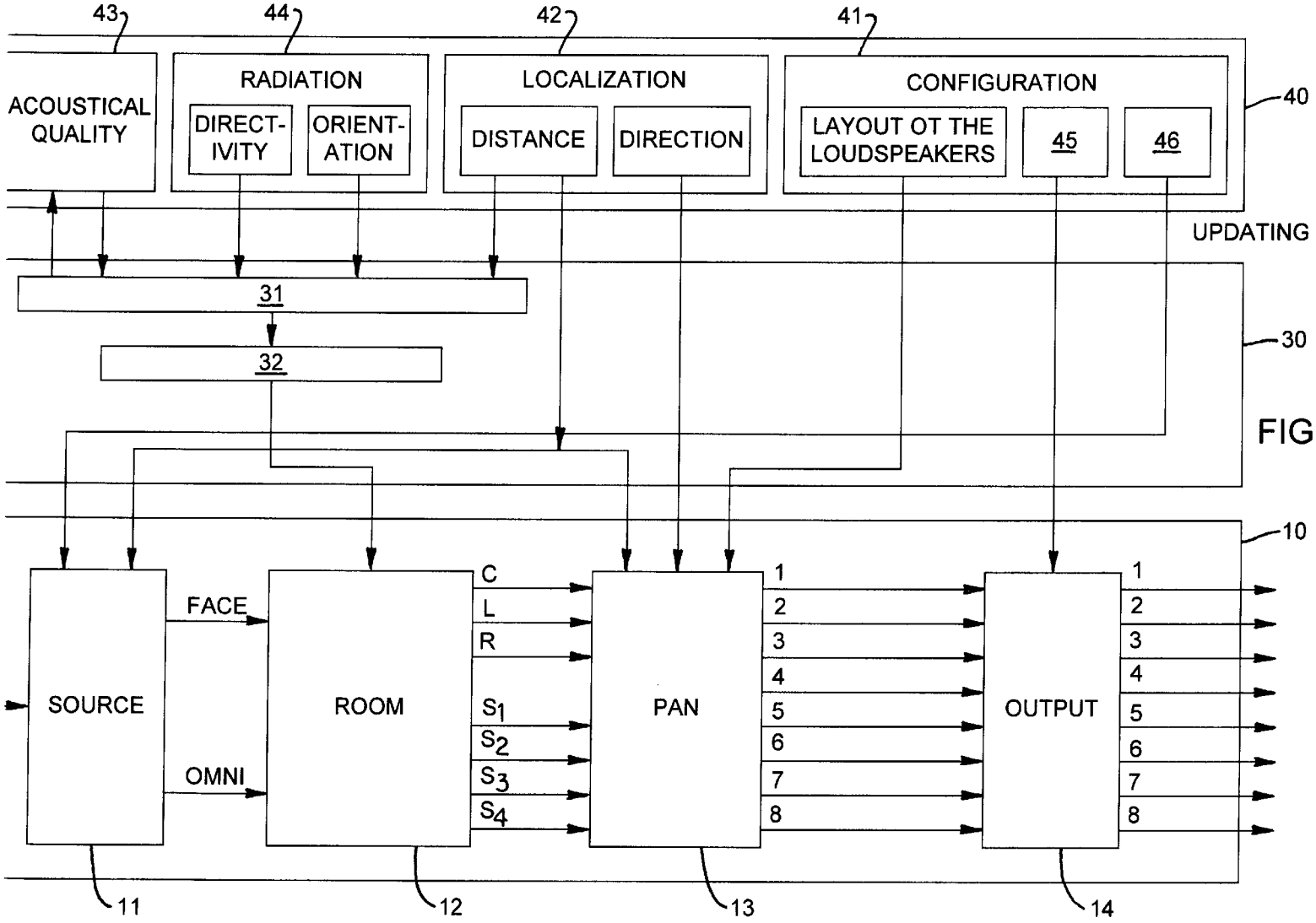
FIG. 3 is a drawing illustrating the influence of a setting interface, of a processor according to the invention, on sound processing modules.

Finally, it is also possible to add on an additional interface to the upper stage capable of controlling and/or activating the setting interface 40 by a remote control 51 or by means of an automatic process 52 or by a gestural control 53 for example The influence of the setting interface 40 of the upper stage on the different sound processing modules 11, 12, 13, 14 will be understood more clearly with reference to FIG. 3.

The setting interface 40 is preferably associated with a graphic control screen and advantageously comprises four control boxes in order to enable a control of the overall acoustical quality 43, the localization 42 of a virtual source, the radiation 44 of this virtual source and finally the configuration 41 of the mode of reproduction associated with the sound pickup and/or reproduction formats or devices.

The control box 41 enabling the control of the configuration of the reproduction mode is generally pre-configured before any use of the processor to process sound signals, i.e. it is for example preset for a particular mode of reproduction such as a binaural, stereophonic or multichannel mode for example. In the case of a multichannel reproduction for example, the configuration control box 41 combines all the parameters describing the positions of the loudspeakers with respect to a reference listening position and transmits them to the "pan" module 13. This description is accompanied by spectral and temporal corrections, using equalizer filters 45, 46, that are to be made respectively to each output channel of the "output" module 14 and to each input channel of the "source" module 11. This configuration control box 41 therefore influences the "pan" module 13, "output" module 14 and signal processing "source" module 11 of the lower stage.

The virtual source localization control box 42 contains azimuth and elevation angle values defining the direction of the source directly transmitted to the signal processing "pan" module 13 of the lower stage. This module thus knows the position of the virtual source with respect to the position of the loudspeakers defined by the configuration control box 41 in the case of a multichannel mode reproduction. This localization command 42 also includes the value of a distance, expressed in meters, between the virtual source and a listener placed at a reference listening position. This distance enables the simultaneous controlling of the duration of a pre-delay in the "source" module of the lower stage, enabling the natural reproduction of the Doppler effect when the distance varies. When the values of the perceptual factors are converted into energy values, a user of the processor according to the invention can furthermore choose to link the distance to a perceptual factor called "presence of the source", of the acoustical quality control box 43. This perceptual factor by itself produces a convincing effect of remoteness through an attenuation of the direct sound and of the primary reflections. This function, shown in FIG. 2, therefore enables virtual sound paths to be reproduced in any space.

In this command interface, the control of the directional localization of the sound source, enabling the simulation of a rotation of the source around the listener, and the step of specifying the layout of the loudspeakers are optional.

The control box 44 of the radiation of the source enables the setting of the orientation and the directivity of the virtual source. The orientation is defined by horizontal and vertical rotation angles, respectively called "rotation" and "tilt" angles. The directivity is defined by an "axis" spectrum representing the sound emitted in the axis of the source and by a "omni" spectrum representing the average value of sound radiated by the source in every direction. These parameters directly affect the total acoustical quality perceived by the listener and must therefore cause an updating of the display of the perceptual factors of the acoustical quality control box 43.

Finally, the control box 43 designed to control the acoustical quality enables the description, in terms of perceptual factors, of the conversion, by a virtual room, of the sound message radiated by a virtual sound source. This command has nine perceptual factors. Six of these factors depend on the position, directivity and orientation of the source: three of them are perceived as characteristic of the source. These three are "presence of the source", "brilliance" and "heat". The other three are perceived as being associated with the room. These three are "presence of the room", "envelopment" and "early reverberance". The last three perceptual factors depend only on the room and describe its reverberation time as a function of the frequency. These last three factors are "late reverberance", "liveliness" and "privacy".

Late reverberance is distinguished from the primary reflections by the fact that it is essentially perceived during interruptions of the sound message emitted by the source while the primary reflections on the contrary are perceived during continuous musical passages.

The perceptual factors of the acoustical quality control box 43, expressed in perceptual units on a scale taking account of the typical sensitivity of the listeners with respect to each of the perceptual factors, are related in a known way to objective measurable criteria. The following table reveals the relationships existing between the objective factors and the perceptual factors, defining the acoustical quality.

| Perceptual factor | Factor notation | Min | Max | Objective criterion notation | Min | Max | Sensitivity |
|---|---|---|---|---|---|---|---|
| Presence of source | pres | 0 | 120 | Es | −40dB | 0dB | 4/dB |
| Heat | warm | 0 | 60 | Desl | −10dB | 10dB | 3/dB |
| Brightness | bril | 0 | 60 | Desh | −10dB | 10dB | 3/dB |
| Presence of room | prer | 0 | 120 | Rev | −40dB | 0dB | 3/dB |
| Envelopment | env | 0 | 50 | Edt | slave | | |
| Early Reverberation | revp | 0 | 50 | Rdl | slave | | |
| Late reverberation | Rev | 0 | 100 | Rt | 0.1s | 10s | 5/dB s |
| Privacy or heaviness | Heav | 0 | 50 | Drtl | 0.1 | 10 | 2.5/dB |
| Liveliness | Live | 0 | 50 | Drth | 0.1 | 1 | 5/dB |

Advantageously, the software interface 30 enabling the conversion of the values of the perceptual factors into energy values comprises an operator 31 capable of performing this conversion and an operator 32 capable of carrying out a context compensation operation so as to take account of an existing room effect.

A general principle of a method of simulation of the acoustical quality that is an object of the present invention assumes that the pulse response of the acoustic channel to be simulated is characterized, on the perceptual plane, by a distribution of energies as a function of time and frequency, associated with a subdivision into a certain number of temporal sections and a certain number of frequency bands. This is shown schematically in FIGS. 4*a* and 4*b*. Hereinafter in the description, the number of temporal sections and frequency bands are respectively equal to 4 and 3. The temporal limits are for example equal to 20, 40 and 100 ms (milliseconds). This provides characterization by 12 energy values. The three frequency bands are, for example, respectively lower than 250 Hz (Hertz) for the low frequency bands, referenced BF, from 250 Hz to 4000 Hz for the medium frequency band referenced MF, and finally higher than 4000 Hz for the high frequency band referenced HF. The values defining these frequency bands are adjustable and a user is quite capable of modifying them to work in wider or narrower bands.

Figure 5:
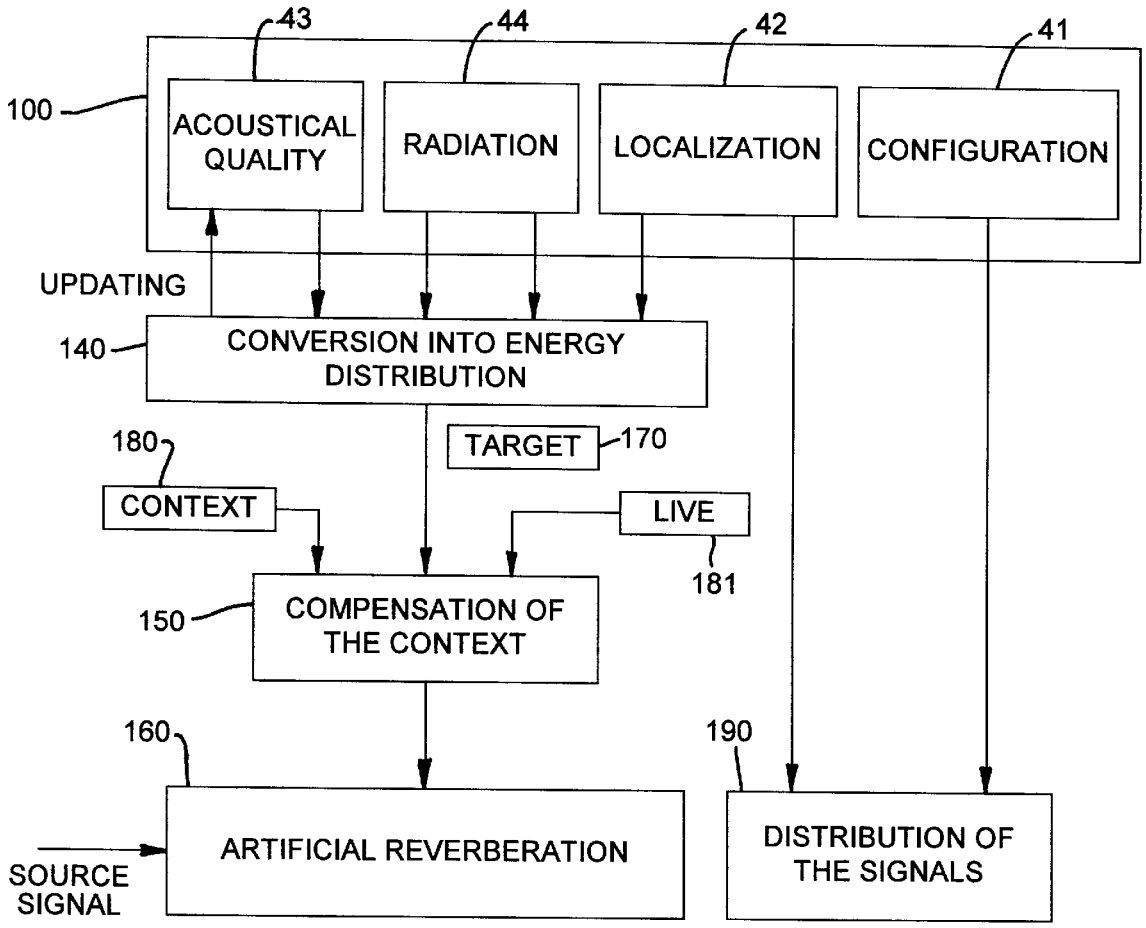
FIG. 5 is a flow chart illustrating the steps of a method according to the invention.

The method that has been described consists of the processing of the sound signals according to the principle described in the flow chart of FIG. 5. This method does not require any assumption about the internal structure of the signal processor.

A first step 100 of a method of this kind consists in using the setting interface 40 of the upper stage of the processor to set the values of the perceptual factors defining the acoustical quality 43 to be simulated, the values of the parameters defining the localization 42 of the virtual source, and the values of the parameters defining the radiation 44, namely the orientation and the directivity of a sound signal emitted by the virtual source.

These values are then converted in a second step 140 into energy values distributed in time and frequency.

A third step 150 consists of the performance of a context compensation operation so as to take account of a room effect existing in any listening room. For this purpose, a perceptual operator controlled by the software interface 30 of the processor for example, modifies the energy values fixed in the first two steps in taking account of the context 180, namely the real acoustics of the listening room and the position, orientation and directivity of each of the loudspeakers in this room.

The step 170 provides for intermediate access to the lower stage in directly providing the energy values that define the desired "target" acoustical quality.

Finally, in a last step 160, an artificial reverberation is obtained from the elementary signals coming from the input signal E in the processor. This reverberation is set up by the "room" module 12 of the processor according to the invention, by means of reverberating filters derived from those described in the French patent application No. 92 02528.

Advantageously, the number of signals at output of the "room" module, enabling the real-time creation of a virtual acoustic, is equal to seven. The intermediate reproduction format is therefore compatible with the ⅔ stereo format and ¾ stereo format illustrated in FIGS. 1*e* and 1*f*. The signal representing the direct sound is transmitted on a center channel C, the signals representing the primary reflections are transmitted on the side channels L and R and the signals representing the secondary reflections and the late reverberation are transmitted on the channels S1, S2, S3 and S4.

Furthermore, the parameters defining the configuration of the reproduction system are transmitted directly to the "pan" module 13 of the processor according to the invention, in a step 190, in order to organize the distribution of the signals towards a reproduction device using loudspeakers for example.

Figure 6:
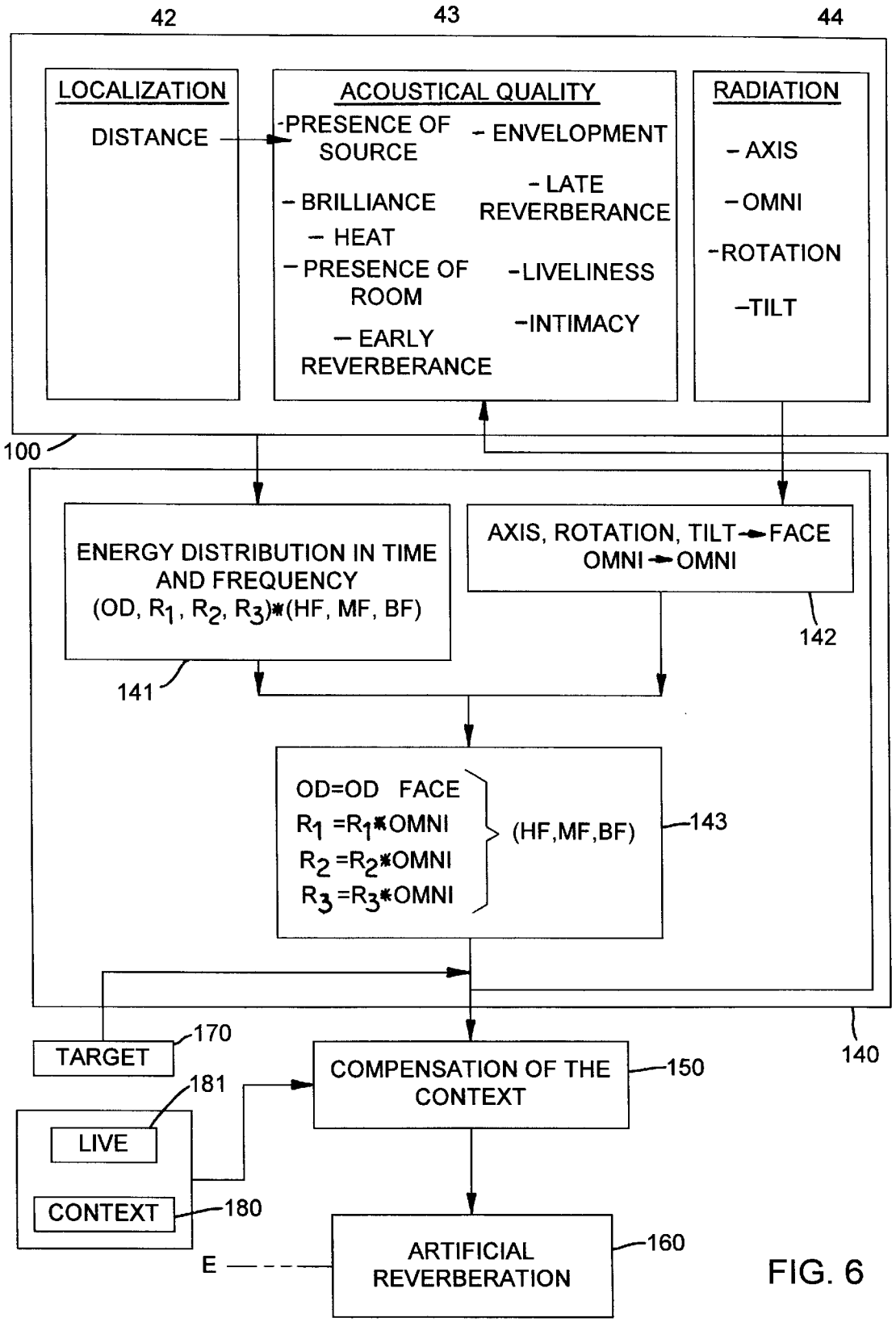
FIG. 6 is a detailed flow chart illustrating the steps of the method of FIG. 5.

The flow chart of FIG. 6 enables a clearer understanding of the different steps of a method of this kind.

Figure 4A:
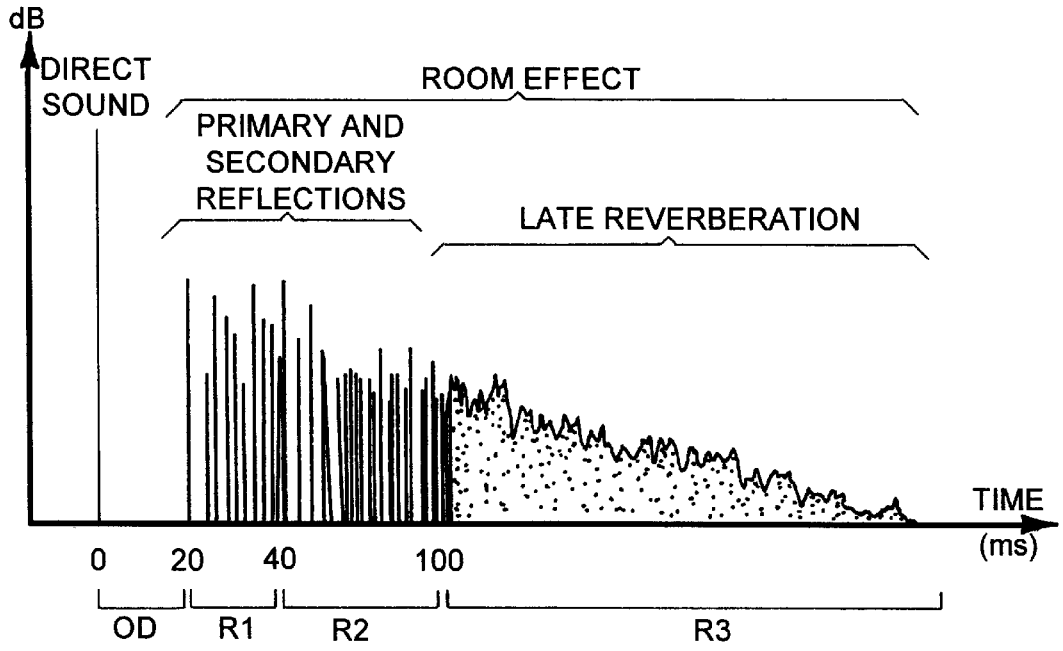
FIGS. 4*a* and 4*b* show a typical response of a room to a pulse sound excitation, indicating its description in the form of energy distribution respectively as a function of time and of frequency.
Figure 4B:
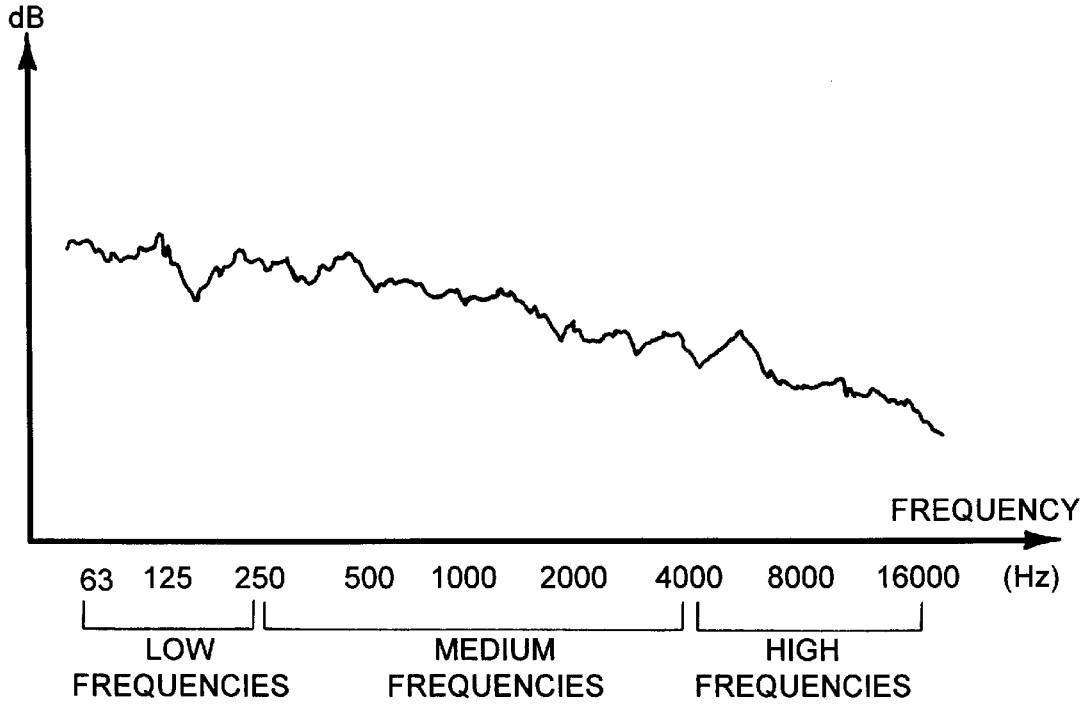

The nine perceptual factors and the distance between the virtual source and a listener, when this distance is related to the "presence of the source" factor, are converted into energy values in the three frequency bands: this is the step 141. These energy values, which are also shown in FIG. 4*a*, correspond to the direct sound OD sent out from the virtual source towards the listener, the primary reflections $R_1$ and the set formed by the secondary reflections $R_2$ and the late reverberation $R_3$.

From the orientation and the directivity of the sources defined in the step 100, using the radiation control box 44, the spectra "FACE" and "OMNI" are computed in the step 142. The spectrum "FACE" takes account of the "axis" direct sound and of the rotation and tilt angles and defines the spectrum of the direct sound emitted from the source to the listener. The "OMNI" spectrum for its part is equal to the "omni" parameter of the radiation control box 44 and corresponds to the scattered sound emitted by the source in every direction.

The values of the energies are then computed in the step 143 in all three frequency bands in taking account of the spectrum "FACE" and the spectrum "OMNI". For this purpose, the value of the energy representing the direct sound OD is multiplied by the spectrum "FACE" while the values of the energies representing the primary reflections $R_1$, the secondary reflections $R_2$ and the late reverberation $R_3$ are multiplied by the spectrum "OMNI".

These three computation steps are carried out in a perceptual operator 140 placed for example in the software interface 30 of the processor.

The conversion of measurable objective criteria into energy values is done by means of the formulae described here below.

The energies referenced OD, $R_1$, $R_2$, $R_3$ and the reverberation time $R_t$ are assumed to be expressed in the mean frequencies. If not, the subscript references "HF" and "BF" are used. All the energy values are expressed in linear scales and the duration values in seconds. The temporal boundaries are assumed to be equal to 0, 20 ms (milliseconds), 40 ms, 100 ms.

$$R_3 = [-C + \sqrt{[C^2 + 0.5*Rev/Es*(1-C)^2]}]*4*Es/(1-C)^2$$

$$\text{if } Rev/Es \leqq 2*(1+C)/(1-C) \text{ with } C = 10^{(-1.2/Rt)},$$

$R_3$=Rev+2*Es else, $R_2=-Es+R_3*[10^{[1.5*(1+(0.4(Edt)/Rt)]}-1]$If Edt>0.4, $R_2=-Es+R_3*[10^{(0.6/Edt)-1}]$ else, $R_1=(Es*Rd1-0.05*R_2)/0.3$ if Rd1 is controlled, $R_1=Es-(Es+3*R_2)/(1+2*Rd2)$ if Rd2 is controlled, $OD=Es-R_1$, $OD_{BF}$=Desl*OD, $OD_{HF}$=Desh*OD, $Rt_{BF}$=Drtl*Rt, $Rt_{HF}$=Drth*Rt However, it is necessary to set constraints on Edt, Rd1 and Rd2 so as to ensure that the values of $R_2$, $R_1$ and OD are always positive. Thus, the maximum value of Rd1 for example is limited in order to prevent OD from becoming zero for the direct sound constitutes the temporal reference on which the definition of all the criteria is based. These constraints are the following:

$Edt_{min}=0.4+Rt*[1-0.667*\log10(1+2*Es/R_3)]$ if $2*Es/R_3 \geqq 30.622$, $Edt_{min}=0.6/\log10(1+2*Es/R_3)$ else, $Rd2_{min}=1.5*R_2/ES$, $Rd2_{max}=0.5+3*R_2/ES$, $Rd1_{min}=0.05*R_2/Es$, $Rd1_{max}=0.3+0.05*R_2/Es$ As described here above, the perceptual factors are related to objective criteria, so much so that they are easily converted into energy values.

The total number of energy values is equal to fifteen since there are twelve values corresponding to OD, $R_1$, $R_2$ and $R_3$ in the three frequency bands and three values corresponding to the reverberation time Rt in the three frequency bands.

At the output of the perceptual operator 140, the energy values are transmitted to another operator 150 enabling the computation of the compensation of the context, so as to modify the values of OD, $R_1$, $R_2$ and $R_3$ in the different frequency bands. Finally, the data elements computed in this operator are then transmitted to the sound processing "room" module 12 so as to obtain a room effect simulation.

The compensation of the context consists in modifying the energy values enabling the simulation of an acoustic system in taking account of three types of messages containing data elements capable of activating the compensation procedure. These messages are the "context" 180, the "target" 170 and the "live" measurement 181.

The "context" is deduced from the existing acoustical quality measured at the reference listening point, produced by each loudspeaker, in the listening room in which it is desired to simulate a set of acoustics. The "target" describes the acoustical quality to be reproduced in this listening room. It is either deduced from the values of the perceptual factors and the localization parameters fixed during the first step of the method or given directly to the context compensation operator 150. Finally, the "live" measurement is taken into account if the input signal E of the virtual acoustic processor should be given by a microphone picking up a "live" source, to describe the acoustical quality produced naturally by this source in the listening room measured at the reference listening point.

For a listener located at this reference point, the natural acoustical quality due to the radiation of the "live" source in the listening room is then superimposed on the artificial acoustical quality simulated by the processor.

The reception of a "target" acoustical quality, namely an acoustical quality to be simulated, prompts its display on the graphic control screen associated with the setting interface 40 of the processor as well as the computation of a context compensation by the operator 150 in taking account of the "context" and "live" measurements.

The compensation procedure is performed automatically in real time, and amounts to deconvoluting the "target" acoustical quality minus the "live" measurement by the "context" measurement, so as to compute the energy values appropriate to obtaining the "target" acoustical quality desired. The "target" acoustical quality is defined by the setting interface 40 of the upper stage of the processor or else by the "target" command 170 acting on the lower stage and giving data elements in the form of energy values.

The principle of context compensation relies on the fact that the output signals of the virtual acoustic processor are divided into N reproduced components per N groups of different loudspeakers and associated with N room effect temporal sections. Hereinafter in this description, N is defined as being equal to three groups: the "center" group, the "side" group and the "scattered" group. These groups are defined respectively to reproduce the direct sound (OD), the primary reflections ($R_1$) and the set formed by the secondary reflections ($R_2$) and the late reverberation ($R_3$). In the processor which is the object of the invention, the allocation of the different loudspeakers to each of these three groups depends on the geometry of the loudspeaker device, namely the parameters of the configuration module 41 and the direction of localization of the virtual sound source. This allocation is done in two steps, in passing through the intermediate ¾ stereo format at output of the "room" module where these three groups of channels are separated: indeed there is one "center" channel, two "side" channels and four "scattered" channels.

Figure 1A:
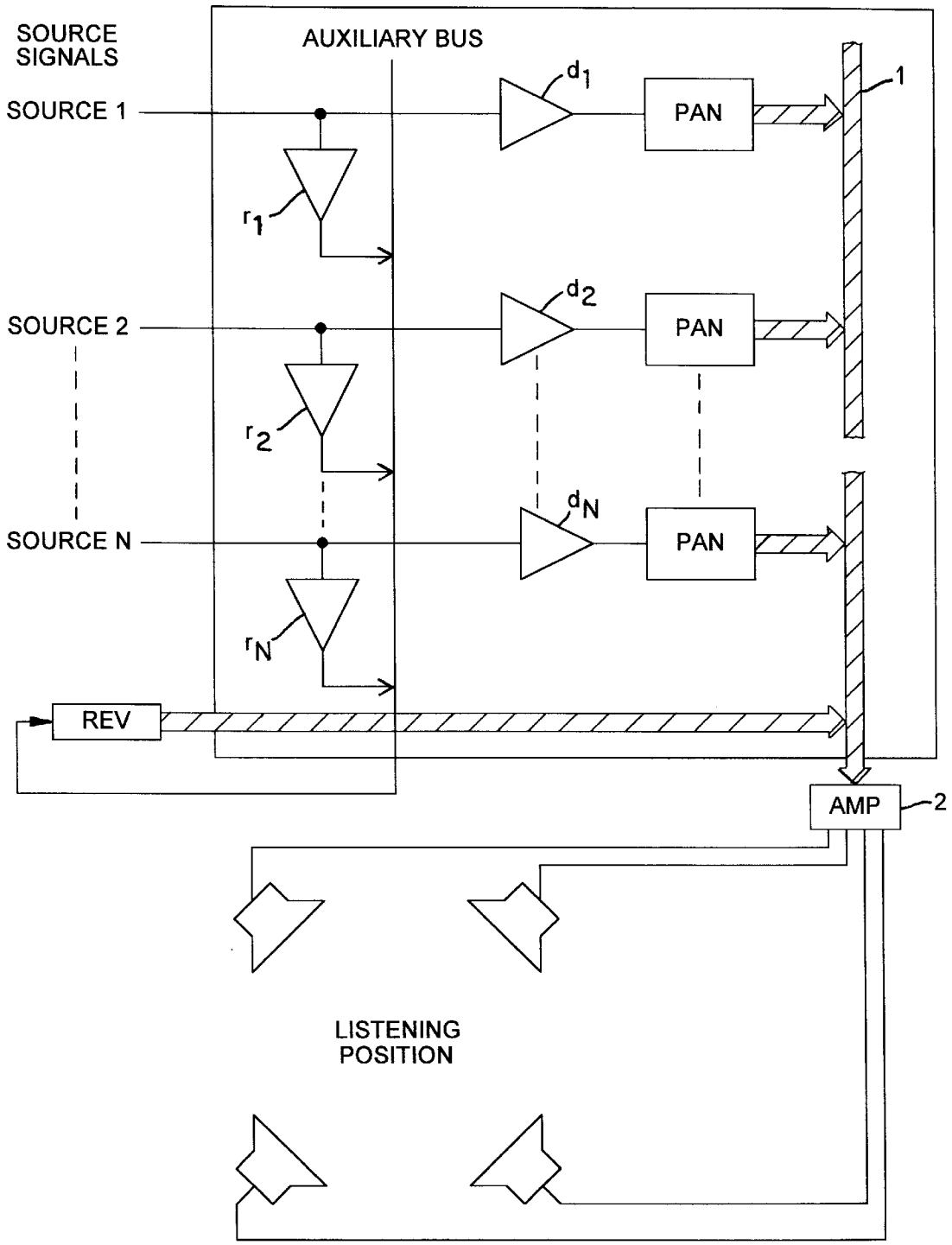
FIGS. 1*a* to 1*c* which have already been described show conventional virtual acoustic processors of the prior art, FIG. 1*d* which has already been described shows a mixing console comprising several virtual acoustic processors according to the invention that are associated in parallel.
Figure 1B:
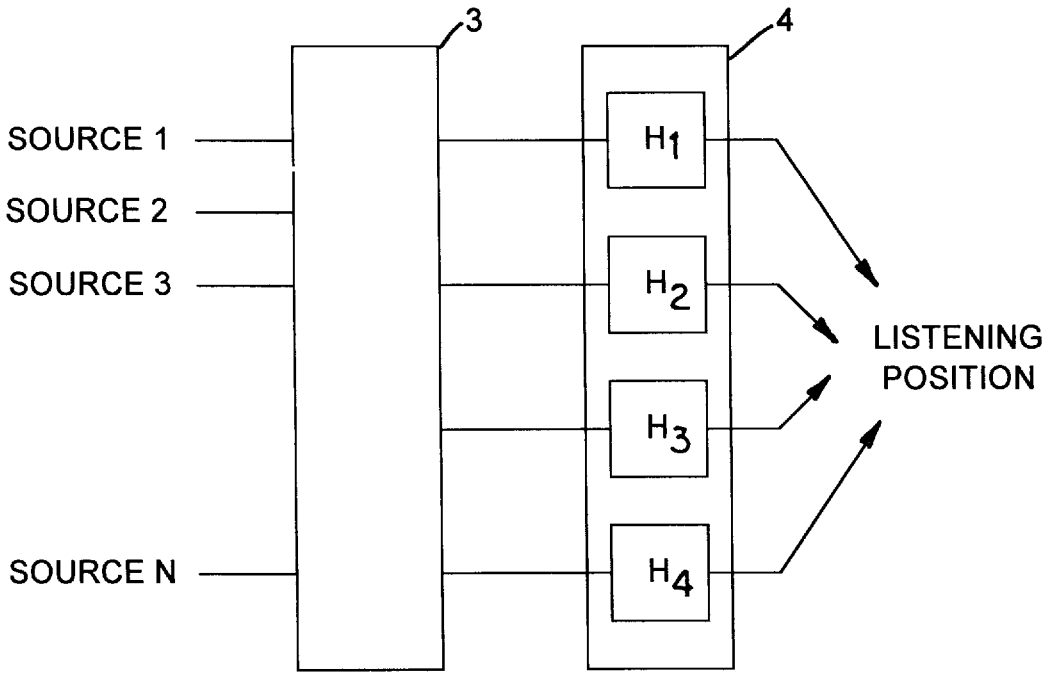
Figure 1C:
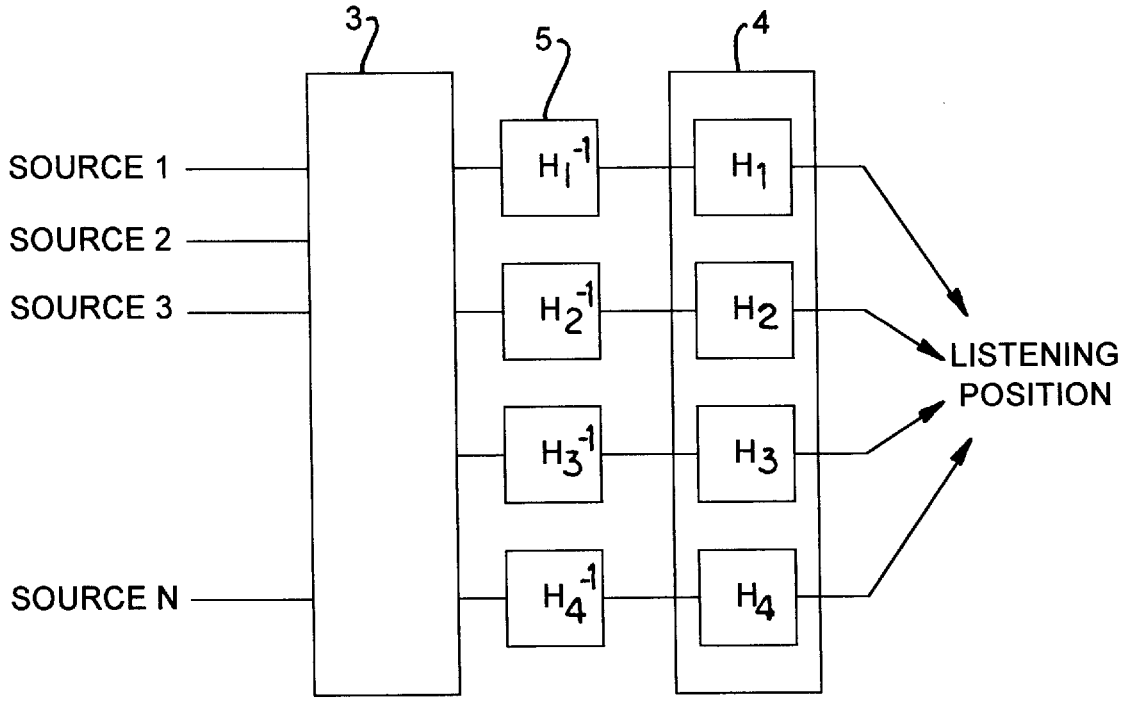
Figure 1D:
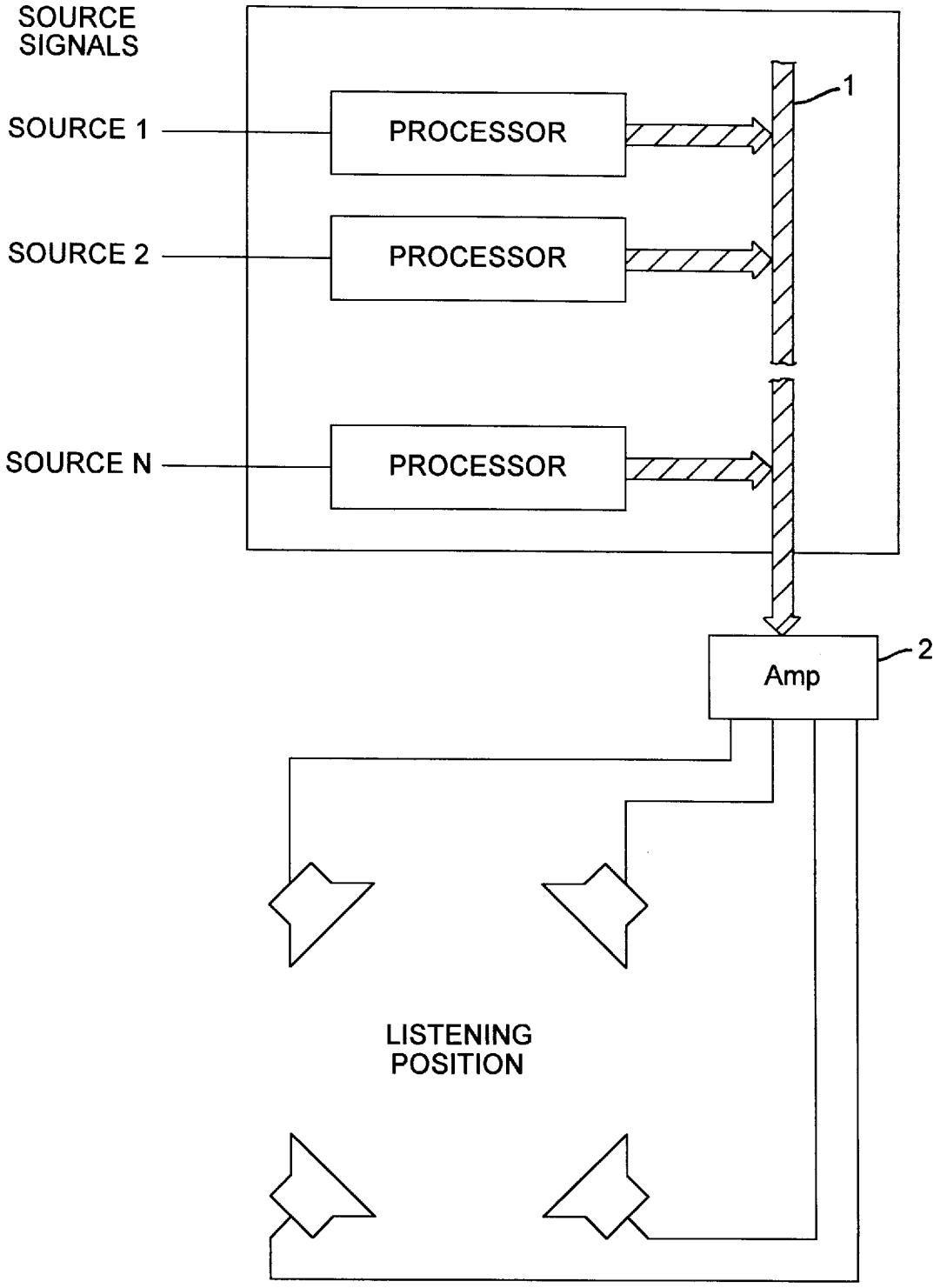
FIG. 1*e* is a drawing of a loudspeaker device compatible with the ⅜ stereo format.
FIG. 1*f* is a drawing of a loudspeaker device compatible with the ¾ stereo format.
Figure 1E:
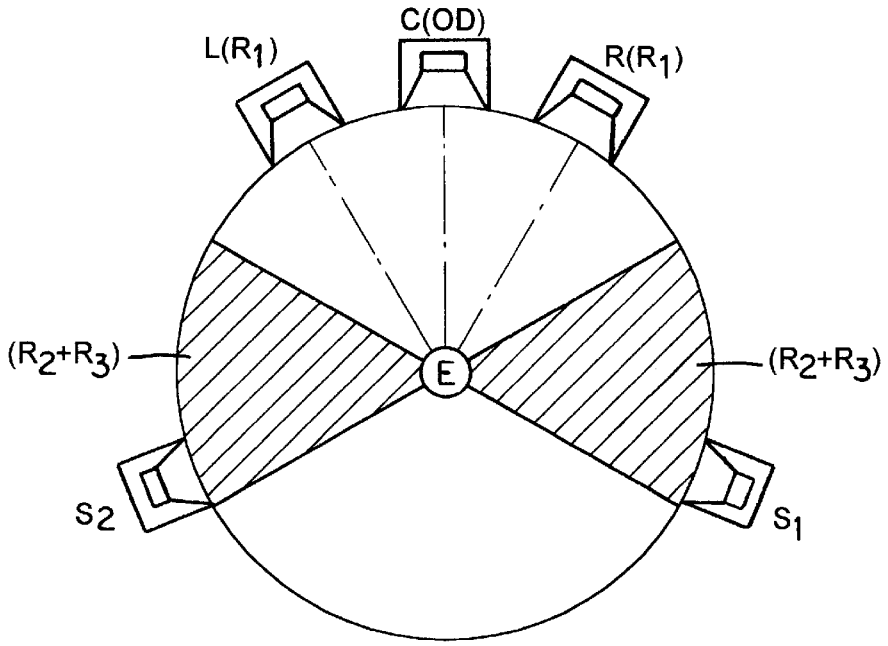
Figure 1F:
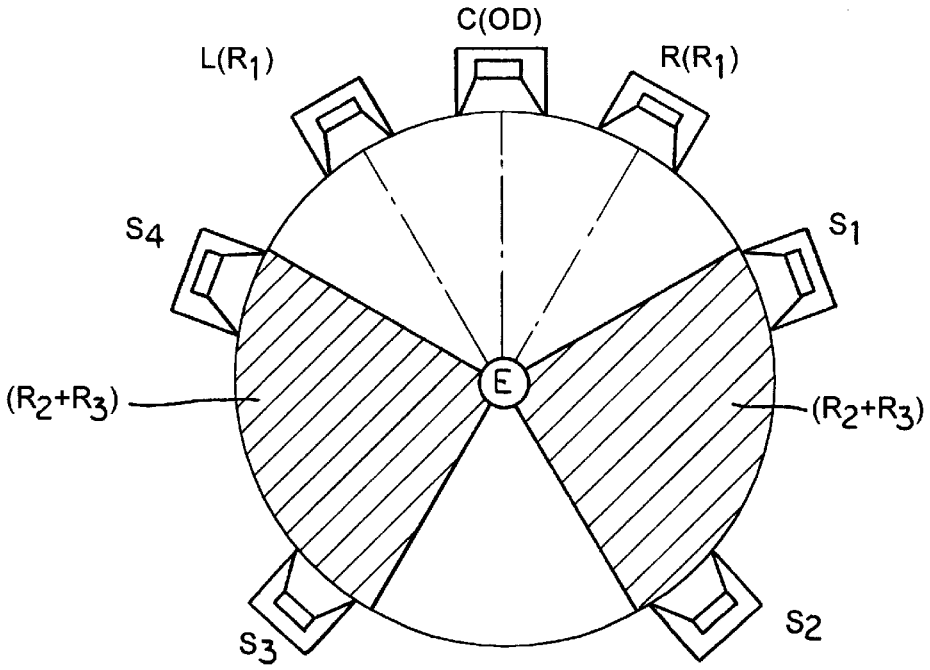

If a listening operation is carried out on seven loudspeakers without using the "pan" module as shown in FIG. 1*f*, the three context measurements are defined as follows:

the "center context" measurement is equal to the acoustical quality produced by the front loudspeaker identified by "C" with respect to the reference listening position, the "side context" measurement is equal to the average of the measurements produced by the left and right front loudspeakers identified by "R" and "L", the "scattered context" measurement is equal to the average of the measurements produced by the rear side loudspeakers, identified by "S1", "S2", "S3" and "S4" where the term "measurement" designates the n-uplet of energies OD, $R_1$, $R_2$ and $R_3$ measured in the three frequency bands when loudspeakers receive a pulse excitation. In the example, n is equal to 3*4=12 energy values. In these measurements, it is assumed that the spectral and temporal corrections performed by the "output" module have been made. These corrections include the temporal shifts and the spectral corrections necessary to ensure that, in the reference listening position, the instant of arrival as well as the frequency content of the direct sound is the same for all the loudspeakers. This correction makes it possible to prevent the listener from perceiving a change of intensity or timbre making the presence of the loudspeakers perceptible during the movements of the sound source.

If the "pan" module is used, it is this module that determines the loudspeakers or groups of loudspeakers to which these three components are assigned. The "scattered" group then remains defined independently of the setting of the position of the virtual source, but the "center" group and the "side" group change as a function of the setting of the direction of localization of the virtual source so as to reproduce a rotation of the source. The computation of the three context measurements therefore makes it necessary to know the gains as regards the feeding of each loudspeaker by each of the output channels of the "room" module. These gains are coefficients defined in a matrix of the "pan" module. This computation may be dynamically refreshed, whenever these gains are modified, by a command for the rotation of the virtual sound source. For this purpose, it is necessary to have reference measurements available in the memory for each loudspeaker.

In one alternative embodiment, it is possible to choose not to carry out this dynamic updating of the "center" context and of the "side" context but to compute them once and for all when the virtual sound source is located in front of the listener for example. Consequently, for a four-loudspeaker device as shown in FIG. 1*d*, and assuming a front sound source, the "center context" is equal to the "side context" and corresponds to the average of the measurements produced by the front right-hand and left-hand loudspeakers while the "scattered context" is equal to the average of the measurements produced by the four loudspeakers.

To modify the energy values in the processor, in order to faithfully reproduce a desired acoustical quality without its being disturbed by the real acoustical quality proper to the listening room, the energy values of the "live" measurement must be subtracted from the energy values of the "target" measurement.

However, there is an additional condition in order that the compensation of the context may be done to perfection: the acoustical quality of the "target" measurement 170 should be more reverberating than that of the "context" measurement 180.

Figure 7:
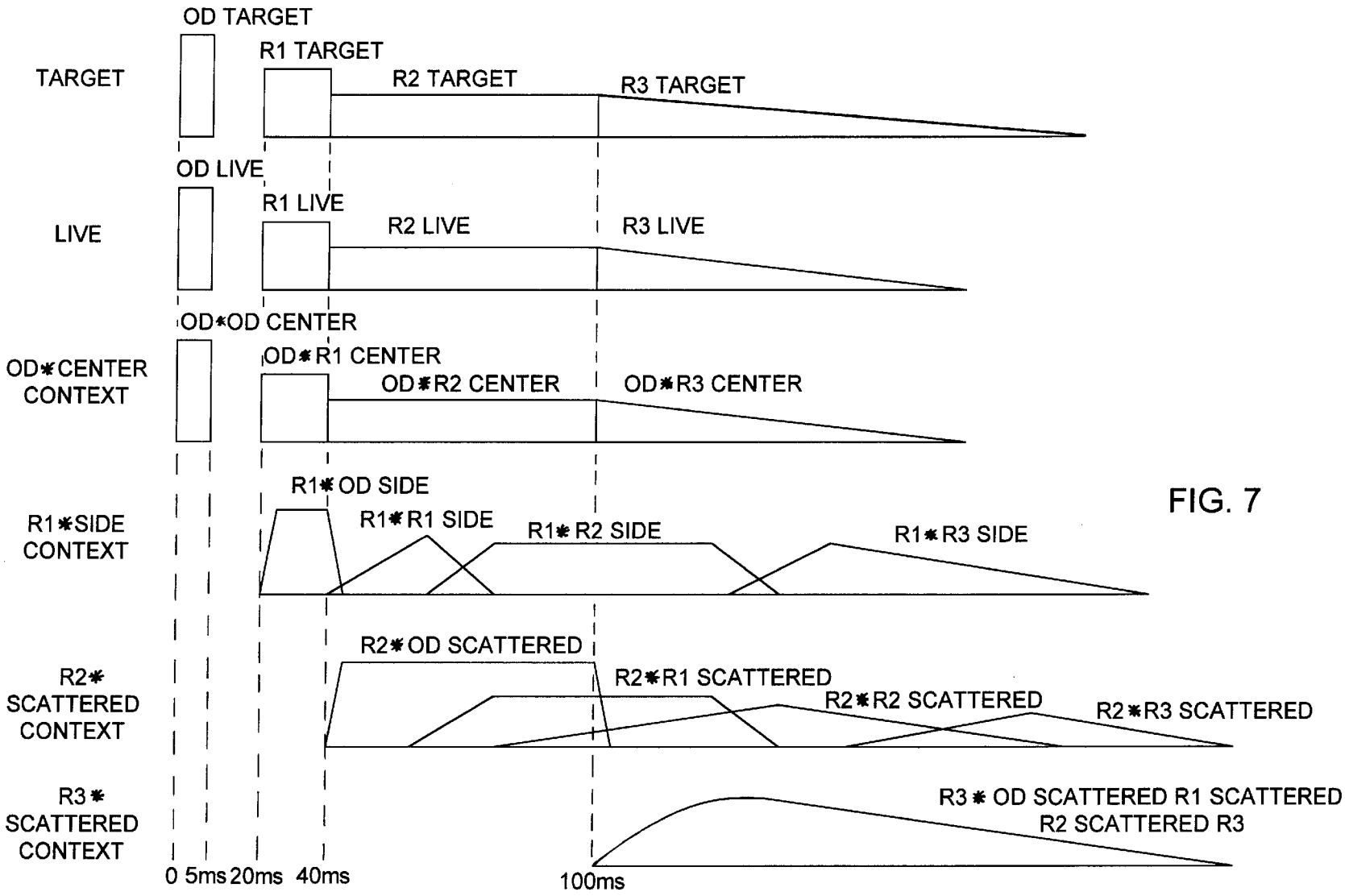
FIG. 7 shows a drawing of an energy balance that is useful for establishing relationships by which a context compensation can be obtained.

In order to be able to prepare the formulae used to modify the energy values in the processor, it is preferable to obtain an energy balance as shown schematically in FIG. 7.

Using this energy balance, it is possible to compute each energy value modified in the three frequency bands in order to simulate an acoustical quality that is faithful to the desired "target" acoustical quality to be perceived by the listener. Indeed, from this balance, it can be seen that the values of the energies of the "target" measurement represent a product of convolution of the energies of the "context" with the energies modified in the processor. Consequently, to know the values of the modified energies, the reverse operation must be performed according to a principle of deconvolution of one echogram by another, i.e. it is necessary to carry out a deconvolution, by the acoustical quality of the "context", of the "target" acoustical quality. If necessary, during the reproduction of a "live" source, the "target" acoustical quality is reduced beforehand by the acoustical quality of the "live" measurement.

The energy balance as shown in FIG. 7 relies on certain assumptions. These assumptions are the following: the energy OD is assumed to be concentrated, for example between 0 and 5 ms, and the "target", "context" and "live" distributions must be expressed with the same temporal and frequency boundaries. The following equations (1) to (4) have been prepared for the following temporal boundaries: 20, 40 and 100 ms. However these equations remain valid when the boundaries are modified homothetically and are, for example, fixed at 10, 20 and 50 ms.

The energy balance therefore can be used for the preparation, in the three frequency bands, of the following expressions of the energies of the "target" acoustical quality:

$$OD_{target} = OD_{live} + OD_{center} * OD \tag{1}$$

$$R_{1target} = R_{1live} = OD*R_{1center} + (7/8)*R_1 *OD_{side} \tag{2}$$

$$R_{2target} = R_{2live} + OD*R_{2center} + R_1*(OD_{side}/8 + R_{1side} + R_{2side}/2) + R_2*(OD_{scattered} *(23/24) + R_{1scattered}/2 + R_{2scattered}/18) \tag{3}$$

$$R_{3target} = R_{3live} + OD*R_{3center} + R_1*(R_{2side}/2 + R_{3side}) + R_2*(OD_{scattered}/24 + R_{1scattered}/2 + R_{2scatterd}*(17/18) + R_{3scattered}) + R_3 * (OD_{scattered} + R_{1scattered} + R_{2scattered} + R_{3scattered}) \tag{4}$$

The center, side and scattered abbreviations correspond to the "center context", "side context" and "scattered context" parameters of the context 180.

From these expressions, there are extracted the modified values of OD, $R_1$, $R_2$ and $R_3$ applied to the three frequency bands and enabling the faithful reproduction of a room effect by minimizing the disturbance given by the real acoustics of a listening room. These extracted values enable the preparation of the following relationships:

$$OD = (OD_{target} - OD_{live})/OD_{center} \tag{5}$$

$$R_1 = \{R_{1target} - [R_{1live} + R_{1center} * OD]\}*(8/7)/OD_{side} \tag{6}$$

$$R_2 = \{R_{2target} - [R_{2live} + R_{2center} * OD + R_1 * (OD_{side}/8 + R_{1side} + R_{2side}/2)]\}/[(23/24) * OD_{scattered} + R_{1scattered}/2 + R_{2scattered}/18] \tag{7}$$

$$R_3 = \{R_{3target} - [R_{3live} + R_{3center} + OD + R_1 * (R_{2side}/2 + R_{3side}) + R_2 * (OD_{scattered}/24 + R_{1scattered}/2 + (17/18) * R_{2scattered} + R_{3scattered})]\}/(OD_{scattered} + R_{1scattered} + R_{2scattered} + R_{3scattered}) \tag{8}$$

The values of the reverberation time $R_t$ remain unchanged in all three frequency bands. They are not affected by the context compensation.

When the "target" acoustical quality is on the whole less reverberating than the "context" and "live" qualities, the equations (5) to (8) may lead to negative values of the quantities OD, $R_1$, $R_2$ and $R_3$. In this case, these values have a threshold set on them at 0 since they represent energy values. The following computations are carried out with these threshold-set values and the user is forewarned about the impossibility of obtaining perfect "target" acoustical quality.

FIGS. 8, 9, 10 and 11 illustrate the way in which the "source" module 11, "room" module 12, "pan" module 13 and "output" module 14 of the virtual acoustic processor, used to implement the method according to the invention, process the sound signals from the data given by the setting interface 40 and by the compensation operator 150.

Figure 8:
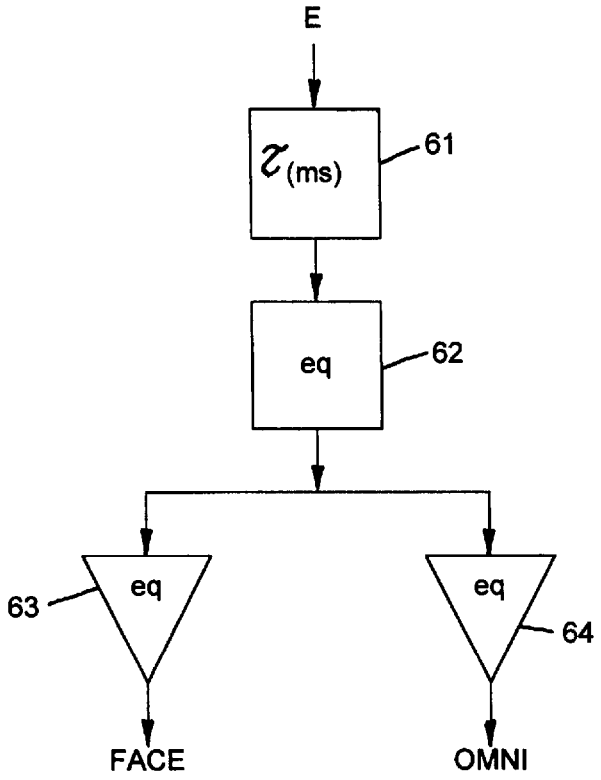
FIG. 8 is an electronic diagram of a sound processing "source" module.

FIG. 8 shows an electronic diagram of a sound processing "source" module. This module is not necessary: it is optional. It receives at least one input signal E and is entrusted with giving the "room" module two signals representing the virtual sound source: the "face" signal representing the acoustic information put out by the source towards the listener and used in the "room" module to reproduce direct sound; and the "omni" signal representing the average acoustic information radiated by the source in every direction, used in the "room" module to supply an artificial reverberation system.

This "source" module enables the insertion of a "pre-delay", namely a propagation delay $TAU_{ms}$ 61, expressed in milliseconds which is proportional to the distance between the virtual source and the listener and is given by the following formula:

$$TAU_{(ms)}=\text{distance}_{(m)}{}^{*}\ 3_{(ms/m)}.$$

This pre-delay is useful for restituting temporal shifts between signals coming from different sources located at different distances. A continuous variation of this pre-delay produces a natural reproduction of the Doppler effect resulting from the shifting of a sound source. This effect affects the two signals, namely "face" and "omni". However, it is possible in one alternative embodiment, to envisage the production of the delay effect without a Doppler effect, or only the Doppler effect, on one of the two signals.

In certain cases, the "source" module may include other pre-processing operations. Thus, in FIG. 8, a spectral correction 62 using a lowpass filter is shown. This correction enables the advantageous reproduction of the air absorption effect. It is expressed as a function of frequency, in decibels per meter (dB/m), and is given by the following formula: $G(f)=0.074*f^2/H$ where the frequency f is expressed in kHz (kiloHertz) and H is the relative humidity of the air expressed in %. If H is assumed to be equal to 74%, this equation becomes:

$$G(f)=f^2/1000,\ \text{namely } G \text{ is equal to 0.1 dB/m at 10 kHz.}$$

It may be useful, depending on the technique of sound pickup or synthesis used in order to give the input signal E, to apply two additional spectral corrections to the signal before providing the two signals, namely "face" and "omni" , feeding the "room" module. This is shown by the equalizer filters eq. 63, 64 in FIG. 8.

According to another alternative embodiment, the additional spectral corrections carried out in this module may very well be integrated into the "room" module. Similarly, the variable delay line 61 enabling the reproduction of the Doppler effect and the filter 62 simulating air absorption may be integrated into the "room" module. These corrections are assigned to specific modules for practical reasons.

Figure 9:
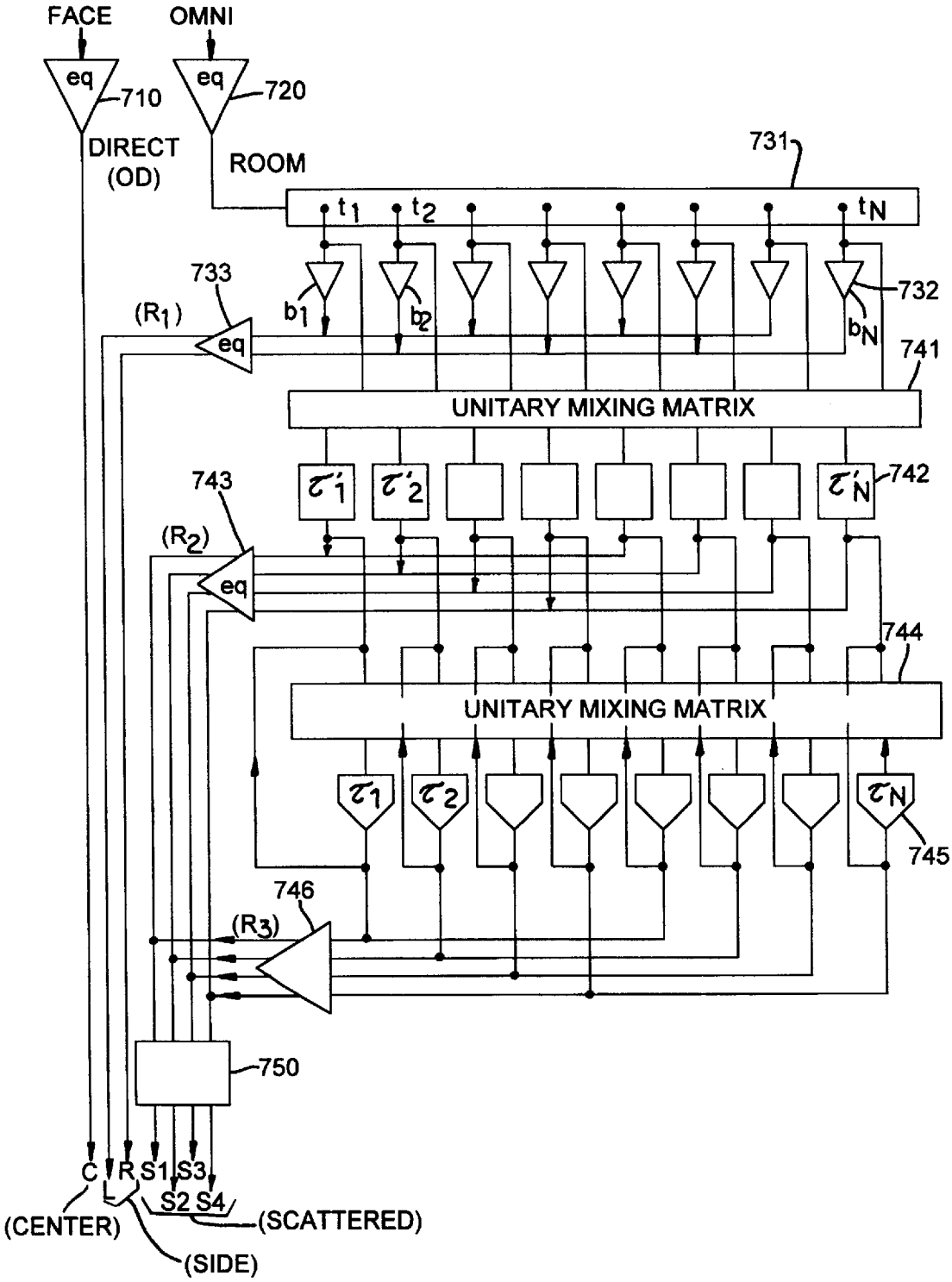
FIG. 9 is an electronic diagram of a sound processing "room" module enabling the creation of a virtual acoustic environment.

FIG. 9 illustrates an example of the way in which the "room" module processes the "face" and "omni" signals coming from the "source" module, using data elements given by the automatic compensation operator 150 with a view to multichannel reproduction on five or seven loudspeakers.

The "room" module thus makes it possible to obtain different delays on elementary signals so as to synthesize a room effect and enable it to be controlled in real time. The module has two inputs and seven outputs. The two input signals coming from the "source" module are the "face" signal and the "omni" signal. The seven output signals correspond to the ¾ stereo format combining three front channels and four "surround" channels.

Two main equalizer filters 710 and 720 are used to take account of the radiating characteristics of the source. The signals coming from these two filters are respectively called the "direct" filter for the direct sound and the "room" filter for the average scattered sound radiated throughout the room. The directivity of the natural sound sources is indeed highly dependent on the frequency. This must be taken into account for the natural reproduction of the acoustical quality produced by a sound source in a room.

Should the sound come from a natural source directed towards the listener for example, the equalizer filter 720 for the "room" signal must be cut off at the high frequencies while the equalizer filter 710 of the direct signal is not cut off. Indeed, natural sources are far more directional in the high frequencies while they tend to become omnidirectional in the low frequencies.

This effect is obtained naturally by means of the perceptual operator 140, for the filters 710 and 720 are controlled respectively by the energies OD and $R_3$ in the three frequency bands.

The signal representing the direct sound is thus influenced by the "axis" and "brilliance" parameters and it comes out of the "room" module after having been filtered by the equalizing digital filter 710, on the center channel "C".

The signal "room" for its part is injected into a delay line ($t_1$ to $t_N$) 731. This delay line 731 enables the constitution of time-shifted elementary signals forming a plurality of early echoes copied from the "room" input signal. In the example shown in FIG. 7, the delay line 731 has eight output channels. Naturally, this line may have a varying number of output channels but the number N of channels is preferably an even number.

The eight output signals then undergo weighted summing operations, by means of adjustable gains $b_1$ to $b_N$ 732, and are divided into two groups respectively representing the left-hand and right-hand primary reflections. A digital equalizer filter 733 is used to carry out a spectral correction on the two signals representing the primary reflections which are then fed into the side channels L and R of the reproduction device. The signals L and R therefore enable the reproduction of the sounds coming from the side loudspeakers neighboring the center loudspeaker as shown in FIGS. 1*e* and 1*f*.

All the eight elementary signals produced by the delay line 731 are furthermore injected into a unitary mixing matrix 741 at the output of which there is placed a delay bank 742. The elementary delays ($TAU'_1$ to $TAU'_N$) are all independent of one another. The eight output signals then undergo summations and are divided into four groups of two signals feeding a digital equalizer filter 743. This filter 743 enables the performance of a spectral correction on the four signals representing the secondary reflections. The four signals coming from this signal 743 form secondary reflections $R_2$ and feed the channels S1, S2, S3, S4.

Finally, the eight elementary signals coming from this delay bank 742 are also injected into a unitary mixing matrix 744 and then, into absorbent delay banks 745 ($TAU_1$ to $TAU_N$) and are looped to the unitary mixing matrix 744 in order to reproduce a late reverberation. The eight output signals are summated two by two to form a group of four signals. These four signals are then amplified by an adjustable gain amplifier 746. The four signals coming from this amplifier 746 form the late reverberation $R_3$.

The four signals representing the secondary reflections $R_2$ are then added to the four signals forming the late reverberation $R_3$ in a unitary matrix 750. This unitary matrix 750 advantageously comprises four output channels linked to the channels S1, S2, S3 and S4 of the "room" module. The output signals S1 to S4 represent the scattered sound coming from all the directions surrounding the listener.

One variant consists of the addition of a filter performing a spectral correction to the signals corresponding to the late reverberation. However, this filter is optional since the spectral contents of the reverberation are already determined by the filter 720 of the "room" signal.

The energy gains at output of the "room" module of the different signals corresponding to the energies OD, $R_1$, $R_2$, $R_3$ can then be determined by means of the following expressions:

$$G_{(OD)}=OD;\ G_{(R1)}=R1/N;\ G_{(R2)}=R2/N;$$

$$G_{(R3)}=R_3*(1/K-1/N) \text{ where } K=\mathrm{SIGMA}_{i=1}^{N}10^{(-6*TAU_i/R_t)}$$

K enables the conservation of the energy $R_3$ of the late reverberation independently of the reverberation time $R_t$ and of the periods of the absorbent delays $TAU_i$.

These formulae can be used to adjust the filters 710, 733, 743 and the gain 746 in the average frequencies, while the gain of the filter 720 is left equal to 1 at these frequencies. By contrast, the spectral correction in the high and low frequencies needed for the energy $R_3$ is obtained by this filter 720 located upline with respect to the filters 733 and 743. Consequently, the corrections performed by the two filters 733 and 743 must be defined in relation to that of the filter 720 to obtain the desired distribution of the energies $R_1$ and $R_2$ in all three frequency bands.

The principle of simulation of the early echoes and of the late reverberation as well as a similar system of artificial reverberation are already known and described in the French patent application No. 92 02528.

At this stage of the method, the intermediate reproduction format with seven channels at output of the "room" module, enabling the performance of an artificial reverberation, has the worthwhile feature of directly enabling a listening operation on a "3/2 stereo" device or "3/4 stereo" device combining three front channels and two or four "surround" channels with respect to the reference listening position. The seven signals C, L, R, S1, S2, S3 and S4 of the "room" module are then transmitted to the "pan" module which is a matrix with seven inputs and p outputs depending on the listening device.

Figure 10:
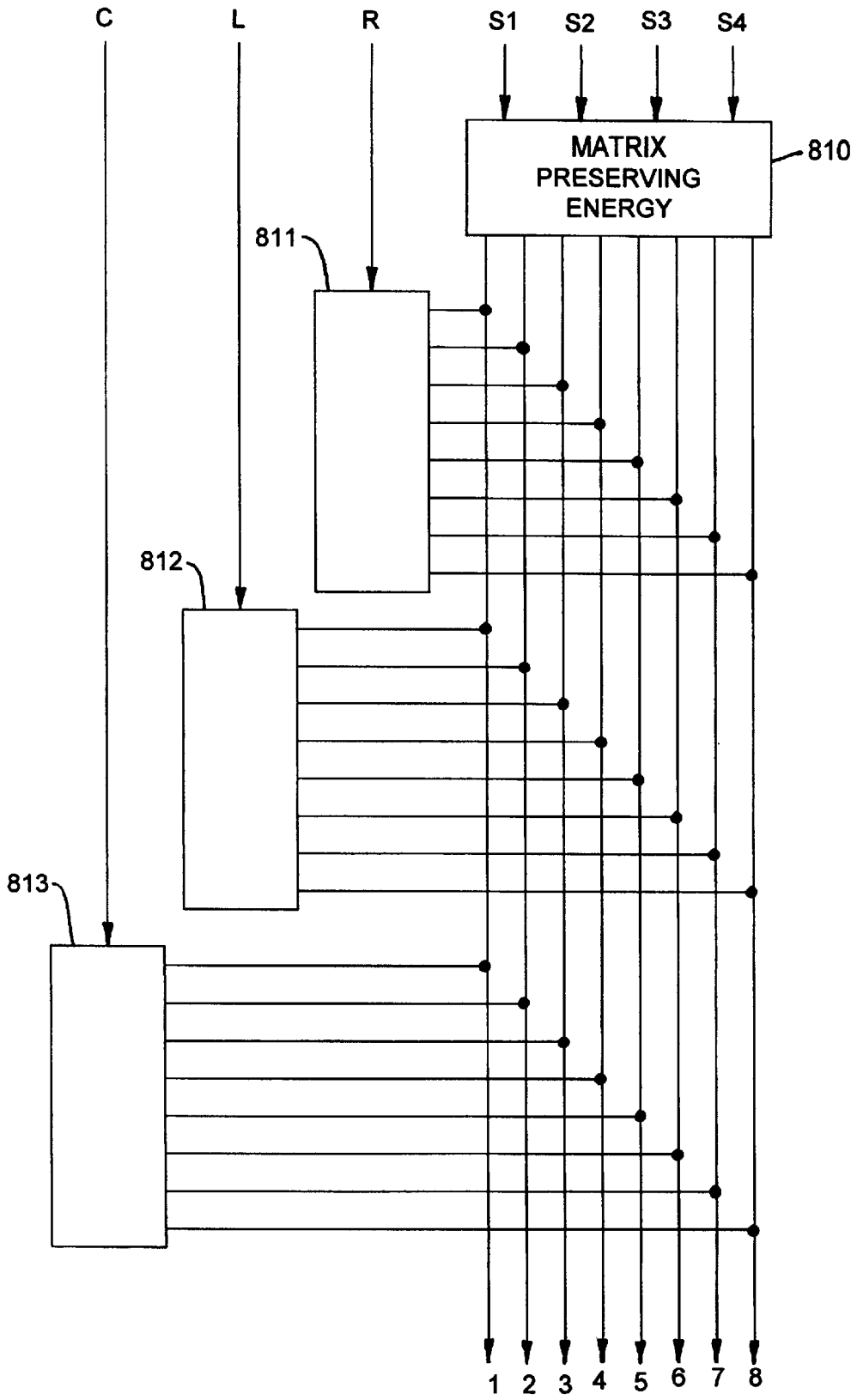
FIG. 10 is an electronic diagram of a sound processing "pan" module.

The "pan" module shown in FIG. 10 can be used in particular to carry out a continuous control of the apparent position of the sound source with respect to the listener. More generally, this module is considered to be a conversion matrix that can receive a signal at the 3/2 stereo format or at the 3/4 stereo format and convert it into another mode of reproduction, i.e. in either the binaural mode or the transaural mode or the stereophonic mode or finally the multichannel mode.

The "pan" module actually contains three panoramic potentiometers 811, 812, 813 provided with a common direction control in order to set the direction of incidence of the primary reflections assigned to the channels L and R, relative to that of the direct sound. This embodiment may be applied to any type of reproduction device on loudspeakers or headphones and achieves a format conversion from a 3/2 stereo or 3/4 stereo standard intermediate format while enabling the control of the apparent direction of localization of the source.

In the example chosen from the beginning of this description, the reproduction mode is a multichannel mode on eight loudspeakers. Consequently, the "pan" module has eight outputs. If the mode of reproduction is done on four loudspeakers, then in this case the "pan" module has four outputs.

The "pan" module is therefore capable of obtaining the virtual rotation of the direct sound C and the side sound coming from the sides L, R while keeping fixed the signals S1 to S4 which represent the scattered sound, namely the secondary reflections and the late reverberation. For this purpose, a matrix 810 enables the conversion of the signals S1 to S4 into eight signals while the other three signals C, L and R are processed by the three panoramic potentiometers 811, 812 and 813. The matrix 810 has eight output channels. Furthermore, the eight output signals of each potentiometer 811, 812, 813 of the "pan" module are summated with the eight signals coming from this matrix.

To understand the working of this module, let us take the example of a reproduction on four loudspeakers. In this case, the direct sound C and the sounds L and R coming from the sides are reproduced on the two loudspeakers facing the listener for example while the other signals S1 to S4 representing the scattered sound ($R_2$ and $R_3$) are reproduced on the four loudspeakers surrounding the listener. When the direct sound C rotates, the signals L and R rotate with it while the signals S1 to S4 remain fixed. Thus, when it is desired to make the direct sound C turn rightwards, the signals C, L and R are reproduced on the two loudspeakers located to the right of the listener while the signals S1 to S4 are again reproduced on the four loudspeakers surrounding it. It is on the basis of this representation that the context is managed.

Figure 11:
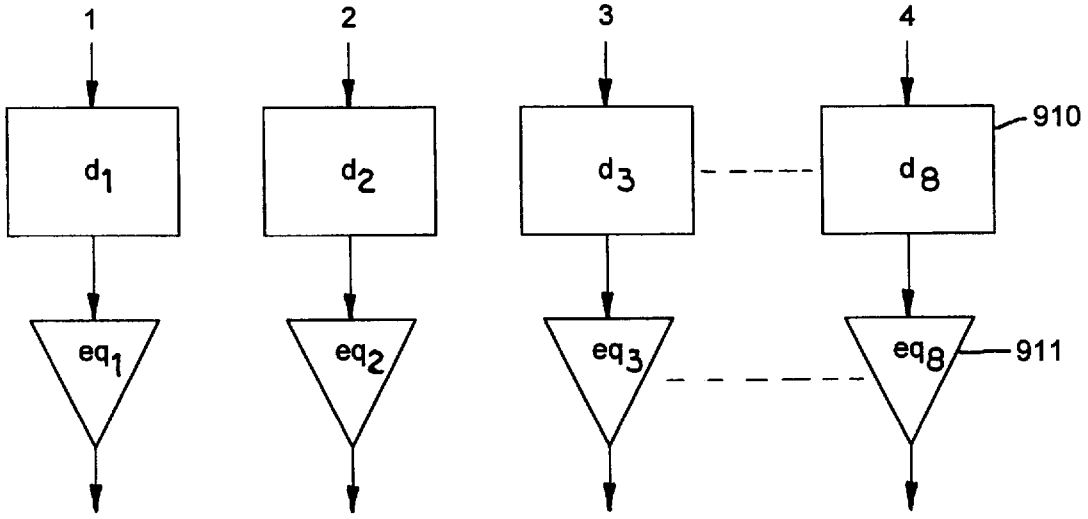
FIG. 11 is an electronic diagram of a sound processing "output" module.

Finally, FIG. 11 shows the way in which the "output" module that is pre-configured processes the signals coming from the "pan" module. The "output module enables the separate equalizing of the frequency response of each of the loudspeakers and makes it possible to compensate for the differences in duration of propagation of the signal. The temporal shifts 910 depend on the geometry of the loudspeaker device. The spectral correction, using the filters 911, must be obtained so that all the loudspeakers are perceived, in the reference listening position, as being at the same distance from the listener and possessing substantially the same frequency response.

What is claimed is:

1. A method of simulating the acoustic quality produced by a virtual sound source in a virtual room and of localizing the virtual sound source with respect to a plurality of listeners in a listening room, the virtual sound source being simulated using loudspeakers and an input signal from an actual sound source, and the listening room being a room in which the listeners listen to the loudspeakers, the method comprising:

A. providing a setting interface, a signal processing room module and a signal processing pan module, B. fixing, using the setting interface, (1) values of perceptual factors defining the acoustic quality produced by the virtual sound source in the virtual room and (2) values of parameters defining the localization of the virtual sound source, C. converting the values (1) and (2) into a pulse response described by its energy distribution as a function of time and frequency, D. performing a context compensation so as to modify the pulse response to compensate for the acoustic properties of the listening room and the position, orientation and directivity of the loudspeakers, E. obtaining an artificial reverberation from elementary signals coming from the input signal, so as to achieve real-time creation of the acoustic quality produced by the virtual sound source, the obtaining step being performed using the signal processing room module, and F. using the signal processing pan module to (1) control the localization of the virtual sound source, (2) control movement of the sound source and (3) carry out a format conversion into another reproduction mode, and wherein, during the providing step (A), the signal processing room module which is provided further includes a first digital equalizer filter which performs a spectral correction of the direct sound, a second digital equalizer filter which performs a spectral correction of the average sound radiated by a sound source in every direction, a delay line which obtains time-shifted copies of the average sound signal entering the delay line and an equalizer filter to filter the signals that represent the sound coming from the sides and are characteristic of the primary reflections, a first unitary matrix associated with a delay bank and with an equalizer filter, and a second unitary matrix associated with absorbent delay banks and with an equalizer filter in order to respectively produce four signals characteristic of the secondary reflections and four signals characteristic of the late reverberation.

2. A method according to claim 1, wherein fixing step (B) further comprises the step of fixing values of parameters defining the orientation and the directivity of a sound signal emitted by the virtual sound source.

3. A method according to claim 1, wherein step (D) further comprises the step of modifying energy values of the pulse response based on a context message which is deduced from an acoustic quality of the listening room measured at a reference listening point, a target message which describes the acoustic quality to be reproduced in the listening room, and a live message which describes the acoustic quality produced by a live source in the listening room measured at the reference listening point.

4. A method according to claim 1, wherein seven signals are used to obtain the artificial reverberation during step (E), the seven signals respectively representing the direct sound, the sound coming from the left-hand and right-hand sides and the average scattered sound coming from all the directions that surround the listeners.

5. A method according to claim 1, wherein the energy values of the pulse response correspond to the direct sound, the primary reflections, the secondary reflections, the late reverberation and the reverberation time in three frequency bands.

6. A virtual acoustic processor enabling the implementation of the method according to claim 1, further comprising a plurality of additional sound processing modules and an operating program associated with an interface for the setting of the perceptual factors that act independently on a parameter expressed in terms of energy values.

7. A virtual acoustic processor enabling the implementation of the method according to claim 1, further comprising a perceptual operator which converts the values of perceptual factors and the values of localization parameters into energy values; and another operator which performs the context compensation.

8. A virtual acoustic processor enabling the implementation of the method according to claim 1, further comprising:

a first source module which, on the basis of a single sound signal, differentiates between the direct sound emitted by a sound source to the listeners and the average scattered sound radiated by the sound source in every direction, a second room module which processes both types of signals coming from the source module so as to simulate the listening room effect, a third pan module which controls the localization of the source and the conversion of the configuration of a mode of reproduction of the signals coming from the room module, and an output module comprising equalizer filters preconfigured according to the reproduction mode chosen in accordance with the configuration of the pan module.

9. A method of simulating the acoustic quality produced by a virtual sound source in a virtual room and of localizing the virtual sound source with respect to a listener in a listening room, the virtual sound source being simulated using an input signal from an actual sound source, and the listening room being a room in which the listener listens to the loudspeakers, the method comprising:

A. fixing, using a setting interface, (1) values of perceptual factors defining the acoustic quality produced by the virtual sound source in the virtual room and (2) values of parameters defining the localization of the virtual sound source, B. converting the values (1) and (2) into a pulse response described by its energy distribution as a function of time and frequency, C. performing a context compensation so as to take account of a listening room effect, D. obtaining an artificial reverberation from elementary signals coming from the input signal, so as to achieve real-time creation of the acoustic quality produced by the virtual sound source, and E. controlling the localization of the virtual sound source, wherein during step (C), the energy values of the pulse response are modified in each frequency band, according to a principle of deconvolution of one echogram by another, and their values are given by the following expressions:

$$OD=(OD_{target}-OD_{live})/OD_{center},$$

$$R_1=\{R_{1target}-[R_{1live}+OD*R_{1center}]\}*(8/7)/OD_{side},$$

$$R_2=\{R_{2target}-[R_{2live}+OD*R_{2center}+R_1*(OD_{side}/8+R_{1side}+R_{2side}/2)]\}/[(23/24)*OD_{scattered}+R_{1scattered}/2+R_{2scattered}/18],$$

$$R_3=\{R_{3target}-[R_{3live}+OD*R_{3center}+R_1*(R_{2side}/2+R_{3side})+R_2*(OD_{scattered}/24+R_{1scattered}/2+17*R_{2scattered}/18+R_{3scattered})]\}/(OD_{scattered}+R_{1scattered}+R_{2scattered}+R_{3scattered})_2,$$

where

OD is the energy value of the direct sound, $OD_{target}$ is the energy value of the target direct sound, $OD_{live}$ is the energy value of the live direct sound, $OD_{center}$ is the energy value of the center direct sound group, $OD_{side}$ is the energy value of the side direct sound group, $OD_{scattered}$ is the energy value of the scattered direct sound group, $R_1$ is the energy value of the primary reflections, $R_{1target}$ is the energy value of the target primary reflections, $R_{1live}$ is the energy value of the live primary reflections, $R_{1center}$ is the energy value of the center group of primary reflections, $R_{1side}$ is the energy value of the side group of primary reflections, $R_{1scattered}$ is the energy value of the scattered group of primary reflections, $R_2$ is the energy value of the secondary reflections, $R_{2target}$ is the energy value of the target secondary reflections, $R_{2live}$ is the energy value of the live secondary reflections, $R_{2center}$ is the energy value of the center group of secondary reflections, $R_{2side}$ is the energy value of the side group of secondary reflections, $R_{2scattered}$ is the energy value of the scattered group of secondary reflections, $R_3$ is the energy value of the late reverberations, $R_{3target}$ is the energy value of the target late reverberations, $R_{3live}$ is the energy value of the live late reverberations, $R_{3center}$ is the energy value of the center group of late reverberations, $R_{3side}$ is the energy value of the side group of late reverberations, and $R_{3scattered}$ is the energy value of the scattered group of late reverberations.

10. An acoustic processor for simulating acoustic qualities of a virtual sound source and for localizing the virtual sound source with respect to a plurality of listeners, the acoustic processor comprising:

(A) a setting interface, the setting interface having set therein values which define an acoustic environment, the values including (1) values of perceptual factors which define the acoustic qualities of a virtual room, and (2) values of localization parameters which define the direction and distance of the listeners from the virtual sound source;

(B) a program, the program including (1) a conversion program, the conversion program being adapted for converting the values of perceptual factors and the values of localization parameters into a pulse response, the pulse response being defined by an energy distribution as a function of time and frequency, and (2) a compensation program, the compensation program being adapted for modifying the pulse response to compensate for the acoustic properties of a listening room and the position, orientation and directivity of the loudspeakers, the listening room being the room in which the listeners listen to the loudspeakers; and (C) a digital signal processor module, the digital signal processor module being adapted for processing sound signals, the digital signal processor module including (1) a room module, the room module including an artificial reverberator, the artificial reverberator being adapted for simulating the effects of the virtual room on sound signals radiated by the virtual sound source, the artificial reverberator operating in real-time on input sound signals from a non-virtual sound source based on the values of perceptual factors set in the setting interface, the room module further comprising (a) a first digital equalizer filter which performs a spectral correction of the direct sound, (b) a second digital equalizer filter which performs a spectral correction of the average sound radiated by a sound source in every direction, (c) a delay line which obtains time-shifted copies of the average sound signal entering the delay line and an equalizer filter to filter the signals that represent the sound coming from the sides and are characteristic of the primary reflections, (d) a first unitary matrix associated with a delay bank and with an equalizer filter, and a second unitary matrix associated with absorbent delay banks and with an equalizer filter in order to respectively produce four signals characteristic of the secondary reflections and four signals characteristic of the late reverberation, and (2) a pan module, the pan module controlling the localization of the virtual source based on the values of localization parameters set in the setting interface.

11. An acoustic processor according to claim 10, wherein the digital signal processor module further comprises:

a source module capable of differentiating between direct sound emitted by a sound source to the listeners and scattered sound radiated by the sound source in every direction; and an output module comprising equalizer filters preconfigured according to the reproduction mode chosen in accordance with the configuration of the pan module.

12. An acoustic processor according to claim 10, further comprising a plurality of additional sound processing modules and an operating program associated with an interface for the setting of the perceptual factors that act independently on a parameter expressed in terms of energy values.

13. An acoustic processor according to claim 10, further comprising a perceptual operator which converts the values of perceptual factors and the values of localization parameters into energy values; and another operator which performs the context compensation.

14. An acoustic processor according to claim 10, further comprising:

a first source module which, on the basis of a single sound signal, differentiates between the direct sound emitted by a sound source to the listeners and the average scattered sound radiated by the sound source in every direction, a second room module which processes both types of signals coming from the source module so as to simulate the listening room effect, a third pan module which controls the localization of the source and the conversion of the configuration of a mode of reproduction of the signals coming from the room module, and an output module comprising equalizer filters preconfigured according to the reproduction mode chosen in accordance with the configuration of the pan module.

15. An acoustic processor for simulating acoustic qualities of a virtual sound source and for localizing the virtual sound source with respect to a plurality of listeners, the acoustic processor comprising:

(A) a setting interface, the setting interface having set therein values which define an acoustic environment, the values including (1) values of perceptual factors which define the acoustic qualities of a virtual room, and (2) values of localization parameters which define the direction and distance of the listeners from the virtual sound source;

(B) a program, the program including (1) a conversion program, the conversion program being adapted for converting the values of perceptual factors and the values of localization parameters into a pulse response, the pulse response being defined by an energy distribution as a function of time and frequency, and (2) a compensation program, the compensation program being adapted for modifying the pulse response to compensate for the acoustic properties of a listening room and the position, orientation and directivity of the loudspeakers, the listening room being the room in which the listeners listen to the loudspeakers; and (C) a digital signal processor module the digital signal processor module being adapted for processing sound signals, the digital signal processor module including (1) a room module, the room module including an artificial reverberator, the artificial reverberator being adapted for simulating the effects of the virtual room on sound signals radiated by the virtual sound source, the artificial reverberator operating in real-time on input sound signals from a non-virtual sound source based on the values of perceptual factors set in the setting interface, and (2) a pan module, the pan module controlling the localization of the virtual source based on the values of localization parameters set in the setting interface;

wherein the energy values of the pulse response are modified in each frequency band, according to a principle of deconvolution of one echogram by another, and their values are given by the following expressions:

$$OD=(OD_{target}-OD_{live})/OD_{center},$$

$$R_1=\{R_{1target}-]R_{1live}+OD*R_{1center}]\}*(8/7)/OD_{side},$$

$$R_2=\{R_{2target}-[R_{2live}+OD*R_{2center}+R_1*(OD_{side}/8+R_{1side}+R_{2side}/2)]\}/[(23/24)*OD_{scattered}+R_{1scattered}/2+R_{2scattered}/18],$$

$$R_3=\{R_{3target}-[R_{3live}+OD*R_{3center}+R_1*(R_{2side}/2+R_{3side})+$$

-continued $$R_2*(OD_{scattered}/24+R_{1scattered}/2+17*R_{2scattered}/18+R_{3scattered})]\}/(OD_{scattered}+R_{1scattered}+R_{2scattered}+R_{3scattered}),$$

where

OD is the energy value of the direct sound, $OD_{target}$ is the energy value of the target direct sound, $OD_{live}$ is the energy value of the live direct sound, $OD_{center}$ is the energy value of the center direct sound group, $OD_{side}$ is the energy value of the side direct sound group, $OD_{scattered}$ is the energy value of the scattered direct sound group, $R_1$ is the energy value of the primary reflections, $R_{1target}$ is the energy value of the target primary reflections, $R_{1live}$ is the energy value of the live primary reflections, $R_{1center}$ is the energy value of the center group of primary reflections, $R_{1side}$ is the energy value of the side group of primary reflections, $R_{1scattered}$ is the energy value of the scattered group of primary reflections, $R_2$ is the energy value of the secondary reflections, $R_{2target}$ is the energy value of the target secondary reflections, $R_{2live}$ is the energy value of the live secondary reflections, $R_{2center}$ is the energy value of the center group of secondary reflections, $R_{2side}$ is the energy value of the side group of secondary reflections, $R_{2scattered}$ is the energy value of the scattered group of secondary reflections, $R_3$ is the energy value of the late reverberations, $R_{3target}$ is the energy value of the target late reverberations, $R_{3live}$ is the energy value of the live late reverberations, $R_{3center}$ is the energy value of the center group of late reverberations, $R_{3side}$ is the energy value of the side group of late reverberations, and $R_{3scattered}$ is the energy value of the scattered group of late reverberations.

* * * * *

UNITED STATES PATENT AND TRADEMARK OFFICE

CERTIFICATE OF CORRECTION

PATENT NO. : 5,812,674
DATED : September 22, 1998
INVENTOR(S) : Jean Marc JOT et al.

It is certified that error appears in the above-identified patent and that said Letters Patent is hereby corrected as shown below:

Column 20, line 13, delete "listening" and insert -- virtual --.

Column 20, line 60, delete "$R_{3scattered})_2$" and insert -- $R_{3scattered})$ --.

Column 20, line 63, after "sound" and before the comma insert -- as measured from approximately between zero milliseconds and twenty milliseconds of when the direct sound is first produced --.

Column 21, line 4, after "reflections" and before the comma insert -- as measured from approximately between twenty milliseconds and forty milliseconds of when the direct sound is first produced --.

Column 21, line 15, after "reflections" and before the comma insert -- as measured from approximately between forty milliseconds and one-hundred milliseconds of when the direct sound is first produced --.

Column 21, line 26, after "reverberations" and before the comma insert -- as measured from approximately after one-hundred milliseconds of when the direct sound is first produced --.

Column 21, line 47, delete "the listeners from".

Column 21, line 48, after "source" and before the comma insert -- with respect to a reference listening position --.

Column 22, line 56, delete "listening" and insert -- virtual --.

Column 23, line 7, delete "the listeners from".

UNITED STATES PATENT AND TRADEMARK OFFICE

CERTIFICATE OF CORRECTION

PATENT NO. : 5,812,674

DATED : September 22, 1998

INVENTOR(S) : Jean Marc JOT, et. al.

It is certified that error appears in the above-identified patent and that said Letters Patent is hereby corrected as shown below:

Column 23, line 8, after "source" and before the comma insert --with respect to a reference listening position--.

Signed and Sealed this

Sixth Day of April, 1999

*Attest:*

Q. TODD DICKINSON

*Attesting Officer*

*Acting Commissioner of Patents and Trademarks*